US005761070A

United States Patent [19]

Conners et al.

[11] Patent Number: 5,761,070

[45] Date of Patent: Jun. 2, 1998

[54] AUTOMATIC COLOR AND GRAIN SORTING OF MATERIALS

[75] Inventors: Richard W. Conners; Qiang Lu, both of Blacksburg, Va.

[73] Assignee: Virginia Tech Intellectual Properties, Inc., Blacksburg, Va.

[21] Appl. No.: 556,815

[22] Filed: Nov. 2, 1995

[51] Int. Cl.[6] ..... G06F 17/30; B07C 5/342

[52] U.S. Cl. ..... 364/478.11; 364/526; 358/518; 358/467; 358/523; 395/131; 395/900; 382/170; 382/165

[58] Field of Search ..... 364/478.11, 526; 358/518, 523, 527, 520, 534, 467; 345/199; 356/419, 406; 395/425, 131; 209/580–587; 382/165, 170

[56] References Cited

U.S. PATENT DOCUMENTS

| | | | |
|---|---|---|---|
| 3,945,729 | 3/1976 | Rosen . | |
| 4,132,314 | 1/1979 | von Beckmann et al. . | |
| 4,278,538 | 7/1981 | Lawrence et al. . | |
| 4,992,949 | 2/1991 | Arden . | |
| 5,020,675 | 6/1991 | Cowlin et al. . | |
| 5,075,768 | 12/1991 | Wirtz et al. . | |
| 5,085,325 | 2/1992 | Jones et al. . | |
| 5,440,127 | 8/1995 | Squyres | 250/341.08 |

FOREIGN PATENT DOCUMENTS 0 194 148 9/1986 European Pat. Off. .

OTHER PUBLICATIONS

S. Yoo et al., *Color Machine Vision Used to Establish Color Grading Standards for Hardwood Dimension Parts*, 1992 International Winter Meeting, The American Society of Agricultural Engineers (Dec. 15–18, 1992).

L. Haney et al., *Color Matching of Wood with a Real–Time Machine Vision System*, 1994 International Winter Meeting, The American Society of Agricultural Engineers (Dec. 13–16, 1994).

R. Conners et al., *A Machine Vision System For Automatically Grading Hardwood Lumber*, "Industrial Metrology 2" (Elsevier Science Publishers B.V. 1992) pp. 317–342.

R. Conners et al., *The Utility of Color Information in the Locatin and Identification of Defects in Surfaced Hardwood Lumber*, First International Conference on Scanning Technology in Sawmilling (Oct. 10–11, 1985).

Lemstrom G et al "Color line scan technology in industrial applications" SPIE–International Society for Optical Engineering, 23 Oct. 1995–26 1995.

Adel, M. et al "Evaluation of Colour Spaces in Computer Vision Application of Wood Defects Detection" Proceedings of the IEEE International Conference on Systems, Man and Cybernetics Part 2 (of 5); pp. 499–504, Oct. 17, 1993.

*Primary Examiner*—James P. Trammell
*Assistant Examiner*—Kamini S. Shah
*Attorney, Agent, or Firm*—Reid & Priest LLP

[57] ABSTRACT

A system for automatically color and grain sorting materials includes a pair of color cameras positioned to view the top and bottom faces, respectively, of each part. A computer analyzes the data from the top and bottom cameras, and also controls the voltage on the input line to each camera. Camera controllers accept analog data from the camera heads and digitize it so that the information can be passed to the computer for analysis. A white target inserted into the field of view of each camera allows the computer to collect the data needed to do "shading compensation" on the collected color image data. Three basic categories of algorithms are used in the sorting system in accordance with the present invention: (1) training algorithms used to teach the system to identify the color and grain classes that are to be used during the sorting process, (2) real-time operation algorithms which perform the color and grain sorts with parts moving through the system at the desired throughput rate, and (3) utility algorithms which allow operators to display images, perform system tests, etc. In the training and sorting algorithms, the computer produces a black/white histogram of a part face based on the data analysis, and applies a character mark algorithm to the black/white histogram to find a threshold value for eliminating the effects of character marks from the color and grain classification and sorting of the part.

55 Claims, 7 Drawing Sheets

B/W histogram of a completely clear part face. The value of $T_{MS}$ should be zero in this case.

B/W histogram of a part with a small amount of very light mineral streak. The dotted vertical line shows an approximate value for $T_{MS}$.

B/W histogram of a part face that contains a larger amount of light mineral streak. The vertical dotted line indicates an approximate value for $T_{MS}$.

B/W histogram of a part face some very dark mineral streak and also with some light mineral streak. The vertical dotted line shows an approximate value for $T_{MS}$.

B/W histogram of a part face with very dark mineral streak. The vertical dotted line shows an approximate value for $T_{MS}$.

B/W histogram of a completely clear part face. The vertical dotten line indicates an approximate value for $T_{MS}$ that would be found using this invention's mineral streak algorithm.

AUTOMATIC COLOR AND GRAIN SORTING OF MATERIALS

BACKGROUND OF THE INVENTION

1. Field of the Invention

The present invention relates to the automatic color and/or grain sorting of materials. The materials which can be sorted by this method include any man-made or natural materials which may vary in color or surface grain structure from one part to another due to natural causes or inconsistences in manufacturing processes. Examples of materials which can be sorted by use of this invention include finished and unfinished hardwood and softwood parts; wood veneers; the hides of animals; birds and reptiles and products made from these hides; ceramic tiles; man-made wood products with and without painted, imprinted, or embossed grain structure; metal and plastic parts with and without painted, imprinted, embossed or molded grain structure; woven and knittend textile products either natural, bleached, dyed, or printed; carpet; and bricks.

2. Related Art

One application of color and grain sorting of materials is in the manufacture of solid hardwood furniture and cabinets which require rough parts that have relatively large dimensions, e.g., door fronts, table tops, etc. These rough parts are typically referred to as panels. Panels are manufactured by edge gluing hardwood parts together where each part is typically of the same length as the panel but is significantly narrower. For the panel to be aesthetically pleasing each of the parts used to create it must have approximately the same color and, to a lesser extent approximately the same grain pattern. To create uniform colored panels requires that the rough parts be color sorted. Currently, this color and grain sorting must be done by hand. This process is somewhat labor intensive and prone to error. Since panels that do not meet manufacturing quality standards must either be remanufactured to create some other component or thrown into the hopper to be burned for fuel, good quality control is essential.

The color and grain sorting of edge glued panel parts can be conceptually divided into three basic operations. First, since each part has two faces, the color class of each face must be determined. Second, using the information about the color class of each face, a decision must be made as to which of the two part faces is the better looking. The "best" face will be the face that appears in the "front" panel face, i.e., in a door front or a table top. Finally, the grain class of the better face must be determined so that the complete color and grain sort can be made. In many applications only a color sort is required. A grain sort is usually only needed for demanding applications such as the export market for Europe.

The color sorting process is complicated by a number of factors. These factors usually result from the heterogeneity of the wood material. A part is not one color but a distribution of colors. There is a low frequency variation in color along the length and width of the piece. This situation is further complicated by a high frequency variation in the grain pattern appearing on a part face. There is further the variation in color from one hardwood species to another. Clearly, the sorting process must vary with hardwood species, i.e., there will be different color classes for each hardwood species. The sorting process may also vary with the product being manufactured, i.e., there might be tighter color quality standards for a high priced item than a low priced item.

Complications also arise given variations in product quality. While the parts to be color sorted should be free of any unwanted wood features, they arc typically not all clear wood. The parts used to make lower quality products may contain areas of mineral streak, small worm holes, and solid knots. Manufacturers refer to such features as character marks. Allowing these character features to appear in parts can markedly affect the number of parts that can be cut from a given volume of lumber. The more character marks that are allowed the greater the part yield. Because of this fact any color sorting system must be able to handle parts with character marks. When a part face contains such marks, the color class of the face is assigned based on the color characteristics of clear wood areas it contains.

Also, the variation that is acceptable across a panel face is usually product quality dependent. In very high quality hardwood tables, chairs, cabinets, etc., the variation in color across the panel must be slight while in lower quality products the variation can be much higher.

In view of the above considerations, together with the variability in wood color with species, any color matching system must provide a mechanism for easily altering the number and types of classes that the system will handle. That is, the system needs to provide the capability of handling a variety of species and provide a mechanism to conveniently switch from one species to another. The system needs to be able to ignore character marks that have been left in part faces while performing the color match. The system needs to have some adjustable parameters that allows a manufacturer to adjust the color uniformity of the sort. High quality products need to have parts sorted into a class in such a way that there is very little color variation from one part to another, while lower quality, less expensive products can be sorted in such a way as to allow a good deal of variation from one part to the next within a color class. To provide flexibility in the manufacturing process, a color sorting device should allow the manufacturer to easily change the priorities of the color classes. If a particular color is badly needed to complete the day's production schedule, any part that can reasonably be sorted into this color class should be so sorted. Finally, wood colors can vary significantly from one part to another. If a part does not reasonably belong to any color class that a sorting system has been taught to recognize, this part should not be assigned to any of these classes but rather should be sorted into an out class.

The grain sorting component of the system needs to have similar flexibility. Since the grain patterns vary significantly with hardwood species, the system must provide the capability to easily switch back and forth among species. As is the case with color sorting the grain sorting operation should not be affected by the presence of character marks. The system needs some parameters that allow the manufacturer to control the uniformity of the grain sort. As is the case with color sorting the quality of the grain match on a sort depends on the quality and price of the item being produced. Also, grain patterns vary significantly from one part to another. If a part has a grain pattern that does not reasonably belong to any of the grain patterns the system has been taught to recognize, it should be sorted into an out class so that plant employees can make the decision as to what to do with the part.

There are a number of color sorting systems on the market and seemingly only one of these systems has the additional capability to do some type of grain sorting. However, existing color matching systems do not provide either the capability to accurately sort hardwood parts into the number of classes that need be considered, nor is the grain matching capability of the only existing system that can perform this function capable of meeting the demands of the hardwood industry.

One of the difficulties in designing a color matching system is the way color is perceived by the human eye. The way humans perceive color was extensively studied in the late 1920's and early 1930's by the German *Commission Internationale de l'Eclairage* (*C.I.E.*). Based on an extensive series of studies that were conducted the C.I.E. [CIE74] proposed the *Trichromatic Theory of Color Perception*. This theory states that human color vision is based only on the perception of three colors, red, green and blue. Thus any color that is perceived can be described as a mixture of these three fundamental colors, i.e., $$C=rR+gG+bB$$

where C is a color, r is the amount of red, R, present, g is the amount of green, G, present, and b is the amount of blue, B, present. The above equation (1) leads very naturally to the concept of a three dimensional color space, where any color C represents a point, (r, g, b) in this color space (see FIG. 10).

While the above is conceptually very straight forward, the complete characterization of color is a bit more complex. First the color of any material is determined by the spectral makeup of light that is reflected from its surface. A material preferentially absorbs certain wavelengths of incident light while reflecting others, e.g., a material that is red in color reflects a large proportion of light in the visible red part of the electromagnetic spectrum, i.e., 600 to 700 nanometers (nm) while reflecting less light in the green (500 to 600 nm) and blue (400 to 500 nm) parts of the spectrum. Since a materials color is based on the preferential absorption and reflectance of incident light, the spectral characteristics of the incident light can alter the human perception of materials color. If, for example, a blue light, i.e., one that produces only visible light in the 400 to 500 nm range, is used to illuminate the red material discussed above, this material will appear black to the human observer.

Therefore to accurately measure the color characteristics of a material, one must specify the spectral characteristics of the light source used to illuminate the surface of the material under consideration, and the spectral characteristics of the sensor. For the C.I.E. the challenge was to define a meaningful standard(s) for the light source to be used and to define the spectral characteristics of the human visual system.

While the C.I.E. actually created several standard light sources, the most obvious choice for a standard is afternoon sunlight. To appreciate this standard one must understand the physics of incandescent sources of light.

A source of radiate energy may be characterized by its spectral energy distribution which specifies the time rate of energy the source emits per unit wavelength interval. The total power emitted by a radiant source, given by the integral of the spectral energy distribution, is called the radiant flux of the source.

A body that exists at an elevated temperature radiates electromagnetic energy. The amount of energy radiated is related to its temperature. A blackbody is an idealized type of heat radiator whose radiant flux is the maximum obtainable at any wavelength for a body at a fixed temperature. The spectral energy distribution of a blackbody is given by Planck's law. The key parameter which specifies the distribution of emitted light energy of a blackbody is the temperature of the body given in degrees Kelvin.

Consequently a way of describing the characteristics of a light source is to compare the spectral energy distribution of this light source with that of a blackbody. The idea is to find the temperature which gives a blackbody irradiator a spectral energy distribution as close as possible to that of the light. If this temperature is T in degrees Kelvin then the light is said to have an effective color temperature of T.

The C.I.E. standard source $S_A$ is a tungsten filament bulb whose effective color temperature is 2854° K. Standard source $S_B$ approximates afternoon sunlight between 400 to 700 nm and has an effective color temperature of 6700° K. Standard source $S_C$ approximates light from an overcast sky between 400 to 700 nm and has an effective color temperature of 4900° K.

The C.I.E. specification for its standard narrow field observer, i.e., sensor, is given by the spectral distribution curves shown in FIG. 2. These curves were experimentally obtained. The experiments involved having observers attempt to match a number of monochromatic colors with the monochromatic primaries red (700 nm), green (546.1 nm), and blue (435.8 nm). The monochromatic colors using the experiments have wavelengths across the visible spectrum. At any one wavelength the values given by the curves represent the relative amounts of red, green, and blue needed to match the monochromatic color of that wavelength. These curves define the axes of the three-dimensional color space discussed above. To see this let $C(\lambda)$ denote the spectrum of visible wavelengths, $\lambda$, of the color C, let $R(\lambda)$ denote the red human response curve of FIG. 11, let $G(\lambda)$ denote the green human response curve of FIG. 11, let $B(\lambda)$ denote the blue human response curve of FIG. 11, and, finally let $I(\lambda)$ denote the spectral characteristics of the illumination source. Then, roughly speaking, the color coordinates (r, g, b) for $C(\lambda)$ are given by $$r=\int C(\lambda)R(\lambda)I(\lambda)d\lambda$$

$$g=\int C(\lambda)G(\lambda)I(\lambda)d\lambda$$

$$b=\int C(\lambda)B(\lambda)I(\lambda)d\lambda$$

The negative values for the red curve from wavelengths 435.8 nm to 546.1 nm shown in FIG. 11 result because the experimental values were adjusted so that the distribution of coefficients for the monochromatic red, green and blue would all be equal for white. The color white is by definition an equal mixture of all colors. Hence the motivation for wanting the coefficients for the monochromatic red, green, and blue all be equal for white.

The presence of $I(\lambda)$ in the above equations mathematically defines the importance of the spectral characteristics of the illumination source in the measurement of color.

Of course, it is not just enough to arrive at a method for measuring color, i.e., defining the (r, g, b) point it represents in RGB space, but it is also desirable to be about to judge the relative similarity or dissimilarity of two colors in a manner that is consistent with human judgments. The C.I.E. also performed experiments on this aspect of the color matching problem. The goal of these experiments was to define a metric, m, on the color space such that if a color $C_1$ is perceived by a standard observer to be more like color $C_2$ than color $C_3$ then $$m(C_1,C_2)\leqq m(C_1,C_3).$$

Defining such a norm across the spectrum of hues the human perceives proved to be a challenging task, one that they were not able to successfully complete. Even though the very important metric m eluded the C.I.E. investigators, the work that they did accomplish forms the basis for modern color measuring/color matching work. Based on the C.I.E. work three things are very clear. To be able to match the color of objects one must:

1. Control the spectral characteristics of the detector. As with the illumination source, the spectral characteristics of the detector must be constant over the time interval measurements are being made. Theoretically, the best detector would be one that matches the spectral characteristics of a standard human observer.
2. Control the spectral characteristics of the illumination source. These spectral characteristics must not change over the time interval over which the measurements are being made, or incorrect measurements will result. Theoretically, the best source to use would be one that matches afternoon sun light on a clear day.
3. Use the three-dimensional color space as the means to represent color, i.e., the measurements needed to identify a color are the triplet (r, g, b).
4. A metric needs to be defined on the three-dimensional color space so that the relative similarity of any two colors can be gauged.

With regard to the sensor, ideally one would like to have a sensor that has the same spectral characteristics as the human eye. However, practical considerations must take precedence. These considerations lead to the selection of a sensor that does not exactly match the spectral characteristics of the standard human observer as defined by C.I.E.

To use the C.I.E. standard observer seemingly requires the use of a spectrophotometer. This device measures the spectral reflectance characteristics of a material measured at, typically, a small circular spot on the materials surface. The result is a vector valued measurement, $\vec{M}$, where each element is the gauged reflectance value for some interval of wavelengths, $\Delta\lambda_i$. The dot product of the vector $\vec{M}$ with vector representations for $R(\lambda)$, $G(\lambda)$, and $B(\lambda)$ can be taken to yield the triple (r, g, b), i.e., the color space coordinate for the color.

This approach has some advantages. First the color measurement made has some basis in human perception. Second, spectrophotometers typically are well calibrated so that there is good agreement from one instrument to another.

Unfortunately, this approach also has a number of disadvantages. Spectrophotometers are expensive. They make measurements rather slowly. This last fact combined with the fact that the color of wood varies continuously across its surface means that employing a spectrophotometer on a wood color matching problem would take a good bit of time. Given the measurement vector $\vec{M}$, finding (r, g, b) is rather computationally expensive. These considerations seemingly suggest that this sensing technology is inappropriate for the color matching of edge glued panel parts.

An alternate approach is to use solid state color camera technology. The output of a color camera is (r, g, b). Therefore, no additional processing is required to get the desired measurement. Color cameras are relatively inexpensive. They can generate data very quickly. Hence, a rough part can be sampled at literally thousands of locations to determine the variations in part color across and down the length of the part. Typically, the output of a color camera is digitized so that 8 bits of information is available in each of the red, green and blue color channels. As such these cameras can sense well over 16 million colors. All the above considerations suggest that this technology seems appropriate for this problem.

Unfortunately, this technology also has some problems associated with it. Solid state charge coupled devices (CCD) cameras have varying sensitivity from one sensing element to another. This means that two spots on a part that have the same color can have different (r, g, b) values as measured by the camera. If any of the points on a part's face that have the same color are to have the same measured (r, g b), then the lighting must be perfectly uniform across the part face. Achieving this uniformity is physically impossible to accomplish given today's state of lighting technology. Hence, a way around these problems must be found.

Another problem involves the fact that color cameras are not calibrated by the manufacturer. Two different cameras can give different color measurements when both are looking at the same part under identical lighting conditions. This fact is of concern here because one of the objectives of a color and grain sorting system is to determine which of a part's two faces is the better to use in a panel. The reason for this is that to meet throughput requires two cameras must be used, one imaging each part face. Therefore, a solution to this problem must be found.

Theoretically, the best standard light source to use in the measurement of color is the C.I.E. standard source $S_B$ that approximates the light of the afternoon sun. Unfortunately, the only light sources capable of generating a 6700° K effective color temperature are arc lamps. These lamps are expensive to buy. Consequently, for at least this application, prudence demands that one look at light sources that have lower color temperatures.

The requirements for a useful light sources arc that (1) it have smooth spectral energy distribution from 400 to 700 nm, (2) that it not have the spectral lines that are present in the light output of most fluorescent bulbs, (3) that its spectral energy distribution function not change significantly across a bulb's lifetime, and (4) that it be relatively inexpensive. The first requirement suggests that some type of incandescent source be used. The second requirement rules out the most inexpensive incandescent technology available, i.e., the normal light bulb, as well as special incandescent bulbs used in color photography that have relatively high color temperatures. Seemingly the best light source for meeting all the above requirements are quartz tungsten halogen bulbs. This is probably the reason the C.I.E. has one standard source based on this technology even though this standard source does not correspond to any naturally occurring lighting situation.

It is important to note that the amount of power produced by an incandescent bulb is directly related Lo the amount of electrical power dissipated across its filament. The amount of light emitted by a normal light bulb will typically drop by 20 percent during the course of its lifetime. This happens because the intense heat on the filament causes atoms of tungsten to be thrown off the filament. Over time this causes the filament to gradually become thinner. The thinner the filament the more resistance it shows to electrical current. This increased resistance lowers the power that is dissipated across the filament which, in turn, reduces the amount of light emitted by the bulb. This same phenomenon holds for the special photo light bulbs used in color photography.

The amount of light emitted by a quartz tungsten halogen bulb, on the other hand, only drops by about 2 percent over the course of its lifetime. The reason for this is the halogen cycle. The halogen in the bulb causes tungsten atoms that are thrown off the filament to reunite with the filament. This, in turn, markedly reduces filament thinning. These bulbs operate at very high temperatures, so high in fact that the filament enclosure must be made of clear quartz rather than glass.

As the above should suggest, there is more to selecting a light source than picking the type of bulb that should be used. There is also the question of providing electrical power. Since spectral energy distribution of any incandescent technology varies with the amount of electrical energy dissipated across the light producing agent, one must carefully control the electrical power that is supplied in order to effectively control the spectral energy distribution. In particular, alternating current sources should not be used to power any incandescent light source since this produces a 120 cycle per second noise on any images produced. Direct current supplies must be used if one is to have any hope of keeping the spectral energy distribution of the source constant over time.

Therefore the target lighting technology that seems appropriate is quartz tungsten halogen. However, there remain two problems left unaddressed by the prior art: (1) selection of the appropriate quartz tungsten halogen bulb, in view of the fact that many are available at different color temperatures; and (2) the supply of constant electrical energy across a bulb's filament.

The prior art also does not successfully address the problem of part surface color representation. As discussed above, any color can be represented by a point (r, g, b) in three-dimensional color space. Hence, the storage requirement for one color is exactly three numbers, to be precise three integers, because the output of the selected color sensor is digitized for input into a computer.

Unfortunately, as was discussed above, the face of an edge glued panel part is not one color but many colors, e.g., the color of early wood, the color of the late wood, and variations on these colors that occur across and down the face. Since many colors are involved, the perceived color of a part face seemingly depends on the distribution of colors appearing on the face. This distribution is seemingly best represented by the probability function P=[p(r, g, b)] where (r, g, b) is any color in color space. For any color (r, g, b) in color space, p(r, g, b) gives the probability with which that color occurs on the part face.

While this representation appears to be the most mathematically sound way of representing the color of a part's face, this representation is computer memory intensive. To understand this, it should be noted that the information coming out of color camera is usually digitized such that there is an 8 bit binary number that represents the value of r, an 8 bit binary number that represents the value of g, and an 8 bit binary number that represents the value of b. Therefore, the number of elements in color space is 256×256×256, or over 16 million elements. Using the above representation to characterize the distribution of colors of a part face requires that a number be assigned to each element, each color, in the three-dimensional color space. Stated another way, the measurement vector used to make the part face color classification is a measure vector that has over 16 million components.

This representation requires that a very large number of values be stored in computer memory, far too much information for an inexpensive system to store and/or process. Hence, another problem that must be solved is to find a way to reduce the dimensionality of the measurement vector used to characterize the color information on a part's face.

Experimentation has shown that a full eight bits from each of the red, green, and blue color channels are not needed to perform color sorts of hardwood. Rather, only six bits are needed. Therefore a straightforward way to reduce the measurement vector is to reduce the full color space from 256×256×256 to 64×64×64. While this reduces the size of the measurement vector from over 16 million elements to one of just over 262,000, a further reduction is still needed. One other possibility is based upon the observation that the color variations in a hardwood species make up only a small part of the 64×64×64 full color space, a marked reduction can be had by only considering those colors the parts will possess. Experiments show that this allows a very significant reduction. Using this approach one can reduce the measurement vector size from over 262,000 elements to one containing only 10,000 to 12,000 elements. However, further reductions are needed if real-time processing is to be possible with inexpensive computing systems, i.e., personal computers.

As discussed above, the C.I.E. made an attempt to find a metric defined on color space that would be able to mimic human judgments of color similarity; and this proved to be a very difficult task. One of the complications was that the C.I.E. group tried to define a metric that would work for any two colors in color space. Given this desire, the experimental data collected indicated that any metric that would mimic human judgment of similarity would have to be a rather mathematically complex function. These findings should not be surprising.

In order to develop a viable edge glued panel part color matching system, a viable color metric must be found that has a simple mathematical definition, that can be quickly computed, and that can, at least partially, mimic human judgments in selected sectors of color space. Defining this metric then is another problem that is not solved by the prior art, and must be addressed.

As was observed above, the colors present in a hardwood species represent only a very small part of color space. Hence, while the C.I.E. studies suggest that developing a general metric is a difficult problem, finding one that works on a very restricted subset of colors might not be difficult. To gain insight into what such a metric or norm should look like, it should be recalled that a description of the color of a hardwood part face seemingly can best be done by defining the distribution of colors present. Let $P_1=[p_1(r, g, b)]$ be the distribution of colors on one part face and let $P_2=[p_2(r, g, b)]$ be the distribution of colors present on another part face. The metric needed must indicate how similar these two distributions are. Since for purposes of this discussion both these distributions represent discrete, quantized functions, a natural set of metrics to examine are the $l_p$ norms used in functional analysis, G. Simmons, *Introduction to Topology and Modern Analysis* (McGraw-Hill, New York 1963). Let X=[x(n)] be a function (vector) containing N, n=1, . . . , N, elements in its domain of definition. Then a $l_p$ norm has the form $$\|X\|_p = \left( \sum_{n=1}^{N} |x(n)|^p \right)^{\frac{1}{p}}$$

Hence for $P_1=[p_1(r, g, b)]$ and $P_2=[p_2(r, g, b)]$, the difference between these two distributions would be defined by a norm of the form $$\|P_1 - P_2\| = \left( \sum_r \sum_g \sum_b |p_1(r,g,b) - p_2(r,g,b)|^p \right)^{\frac{1}{p}}.$$

The question is which $l_p$ norm is the most appropriate one to use.

The prior art encompasses a number of color sorting systems—for example those disclosed in U.S. Pat. Nos. 3,945,729; 4,132,314; 4,278,538; 4,992,949; 5,020,675; 5,075,768; and 5,085,325—each aimed at a particular application. U.S. Pat. No. 3,945,729 to Rosen, titled "Combined Ranging and Color Sensor," describes a system for measuring both range and color. A primary limitation of this system is the light source used. The light source employed is a mixed gas laser that emits light in only three wave lengths in the interval from 400 to 700 nanometers. While not specifically stated, it is assumed that one of the wavelengths is in the red region (600 to 700 nm), one in the green region (500 to 600 nm) and one in the blue region (400 to 500 nm). This type of illumination makes separating colors that are very similar to one another impossible. Another problem with this system is the color sorting algorithm. The sorting is based on three measurements, $$r_n=r/(r+g+b)$$

$$g_n=g/(r+g+b)$$

$$b_n=b/(r+g+b).$$

The sorting algorithm makes the color assignment by determining which interval of the R color axis $r_n$ is in, which interval of the G color axis $g_n$ is in, and which interval of the B color axis $b_n$ is in. This sorting algorithm is capable of only crude color sorts. Finally, using the normalized quantities ($r_n$, $g_n$, $b_n$) means the system is insensitive to how light or dark a color is. This system can only separate color with different hues and saturations. The above limitations mean that this system is inappropriate for the color sorting of edge glued panel parts.

U.S. Pat. No. 4,278,538 to Lawrence et al., titled "Methods and Apparatus for Sorting Workpieces According to Their Color Signatures," describes a system for very accurately color sorting parts based on point measurements on a materials surface. The specific application of the system contemplated by Lawrence et al. is to color sort parts used in making telephones. The system described once again uses normalized color coordinate values just as the system described above does. Hence it cannot separate colors that are different because of intensity differences. This limitation makes this system inappropriate for the sorting of edge glued panel parts.

U.S. Pat. No. 5,020,675 to Cowlin et al., titled "Apparatus for Sorting Conveyed Articles," describes the materials handling and imaging components of a system for finding blemishes on fruits and vegetables. The corresponding method for finding the blemishes is described in European Patent Application Publication No. 0 194 148. The blemish finding algorithm disclosed in the European Patent Application is based on finding areas that have significantly different color from the surrounding areas. As such this system does not address the problem of sorting parts into a preselected number of color classes, i.e., the problem that need be addressed in sorting edge glued panel parts.

U.S. Pat. No. 5,075,768 to Wirtz et al., titled "Method and Apparatus for Color Separation Scanning," describes an inexpensive color scanning system for use by the printing industry. The objective of this system is to color scan original art work and to use the color imagery to output to a color printer. The methods described by Wirtz et al. are inappropriate for the sorting of edge glued panel parts.

U.S. Pat. No. 5,085,325 to Jones et al., titled "Color Sorting System and Method," describes a system For sorting color parts. This system uses a color lookup table that contains reject data at those addresses for colors to be rejected. Since this system is designed only to reject undesirable colors, its functionality is not appropriate for the sorting of edge glued panel parts.

The only patent of which the present inventors are aware, which covers a system aimed at the color sorting wooden parts is U.S. Pat. No. 4,992,949 to Arden, titled "Color Sorting of Lumber." Before the development was begun on the present invention, the methodologies covered by the Arden patent were extensively tested. They were found to be unable to provide the types of sorts needed in sorting edge glued panel parts. The primary limitation of this system comes from the way Arden chose to reduce the storage requirements associated with the three-dimensional color space. The method selected does not capture all the required information contained in the full three-dimensional space.

As was discussed above, the most appropriate mathematical representation for the distribution of colors on a part face appears to be the estimated probability function P=[p(r, g, b)]. Rather than use this memory intensive representation, Arden chose a less memory intensive representation, one that involves three estimated probability functions each only containing 256 elements. The three probability functions used are $P_r=[p_r(r)]$, the probability distribution of the red; $P_g=[p_g(r)]$, the probability distribution of green; and $P_b=[p_b(r)]$, the probability distribution of blue. Note that each of these probability functions can be directly computed from P=[p(r, g, b)], i.e., $$p_r(r)=\Sigma_g\Sigma_b p(r, g, b)$$

$$p_g(g)=\Sigma_r\Sigma_b p(r, g, b)$$

$$p_b(b)=\Sigma_r\Sigma_g p(r, g, b).$$

Unfortunately, while using these three probability functions markedly reduces that amount of information that must stored and processed, these three functions do not contain all the important information contained in P. Extensive experimentation showed that this approach is incapable of separating dark brown oak parts from dark red oak parts, seemingly a requirement of any robust edge glued panel part color sorting system.

Finally, researchers at Purdue University have developed a system for establishing color grading standards for hardwood dimension parts, described in the paper titled "Color Matching of Wood with a Real-Time Machine Vision System," by L. Haney et al., Paper No. 94357, presented at the 1994 International Winter Meeting Sponsored by ASAE. This system uses a color camera to image parts and a combination of quadratic Bayesian classifier and neural network to determine to which class a part belongs. The system is capable of sorting into three color classes, white, pink, and brown. The quadratic Bayesian classifier is applied first. It attempts to label each color pixel as either being background, defects, grain, white, pink, brown. Using the percentages of pink, brown, and white pixels appearing on each part face, another quadratic Bayesian classifier and a neural network are used to make the final classification.

Unfortunately, the Purdue system has serious flaws. First, the color of grain varies significantly from one part to another, as does the color of defects and even the color of pink, white, and brown. It is possible, even very probable, that one brown part may have grain the same color as the non-grain areas of another brown part. Given this situation, it seems very unlikely that any statistical classifier that defines decision boundaries in three-dimensional color space will give accurate results of the variety of color classes needed to color match edge glued panel parts. The major difficulty is that parts from one color class may have portions of their surfaces which are the same color as areas on parts from another color class.

It is to the solution of the above-described and other problems to which the present invention is directed.

SUMMARY OF THE INVENTION

A system that can automatically color and/or grain sort materials, in particular panel-type parts having two opposite faces (a first or top face and a second or bottom face) to be color and grain sorted, is achieved by the provision of a materials conveyor for moving the part; a pair of color CCD line scan cameras positioned to view the top and bottom faces, respectively, of the hardwood part; quartz tungsten halogen lamps positioned to illuminate the top and bottom faces, respectively, of the hardwood part; a single switching power supply providing DC power to the tungsten halogen light sources; and a computer for analyzing the data from the top and bottom cameras.

Two color cameras are employed, one for imaging each board face. Each color camera has the appropriate infrared cutoff filter so that the sensitive locations on the charge coupled device (CCD) only respond to light in the visible range. To reduce the amount of dark current produced by each camera, the cameras are contained in cooled enclosures. The cooling assures the cameras operate at a constant temperature.

The power for the quartz tungsten halogen comes from a single switching power supply which provides DC power so that the color images obtained from the color cameras do not have stripping caused lighting variations induced by AC power.

The switching power supply used has an input line that is used to control how much power is supplied to the bulbs. The power supplied depends on the voltage presented on the input line. The computer controls that voltage on this line using a digital to analog converter. The amount of voltage supplied is based on an examination of a target appearing in one of the camera's field of view outside the area in which the part appears. Picture elements (pixels) that cover an area of this target are averaged. This average is compared to a standard. If the average is slightly below the standard more voltage is applied to the line to the switching power supply. This causes the power supply to increase the voltage supplied to all the quartz tungsten halogen bulbs. If the computed average is slightly above the standard the computer reduces the voltage on the line to the power supply. This causes the power supply to decrease the amount of power supplied to all the quartz tungsten halogen bulbs. If the average is markedly different from the target, system operation is halted and an alarm is displayed on the system console to inform operators that a bulb has burned out. There is a similar target appearing in the other camera's field of view outside the area in which the part appears. Pixels from this camera that cover an area of this second target are also averaged. This average value is just checked to determine if a bulb illuminating the bottom camera's field of view has burned out.

In one aspect of the invention, the computer and the switching power supply are enclosed in a dust free enclosure that is air-conditioned to maintain a steady operating temperature, to improve computer reliability and the stability of the power provided to the quartz tungsten halogen bulbs.

In another aspect of the invention, the light emitted from the quartz tungsten halogen bulbs is sent through a fiber optic light line. The light emitting from these lines illuminates the parts. Alternatively, the bulbs directly illuminate the surface.

In still another aspect of the invention, camera controllers accept analog data from the camera heads and digitize it so that the information can be passed to the computer for analysis. In one embodiment of the invention, a single analog to digital (A/D) converter is used in the controller, and blue filters are used on the cameras. These filters assure that red, green, and blue values will be reasonably close when a white target is inserted into a camera's field of view.

In a preferred embodiment of the invention, three different A/D converts are used, each having its own offset and gain, thus eliminating the need for the blue filters.

In one embodiment of the invention, the color image data coming from a camera is directly transferred to the computer using a direct memory access (DMA) computer interface, allowing image data to be placed in computer memory without the need for the computer's central processing unit to have to perform any functions. In this embodiment, an optical sensor and an ultrasonic width sensor are also provided. The optical sensor determines when a part is about to enter the field of view of the two cameras and turns the cameras on and off. The ultrasonic sensor is used to determine the number of pixels on each CCD line scan camera that must be read.

Also in a preferred embodiment of the invention, data from a color camera is first passed through a high speed processing board that performs certain operations on the image data. The results of this processing are then passed to the computer via the DMA interface discussed above. In this embodiment, the determination of the width and the location of the leading and lagging edge of the part is determined by the high speed processing board. Therefore, no sensors arc provided, the cameras stay on all of the time, and the processing board only sends data for each part to the computer.

In a further aspect of the invention, two pneumatic devices controlled by the computer selectively insert a white target into the field of view of each camera where the edge glued panel parts pass through. The white target allows the computer to collect the data needed to do "shading compensation" on the collected color image data. Alternatively, the white targets are attached to the opposite faces of a carrier and are transported to the cameras by the materials conveyor.

In one embodiment of the invention, the shading compensation is done only on the digitized imagery. In a preferred embodiment of the present invention, a "rough" analog shading correction is performed by the camera controller prior to the A/D conversion of the color imagery. After conversion, another "fine" shading correction is performed on the digital imagery. The rough analog shading correction is performed by controlling the offset and gain for each pixel going into each A/D converter.

Three basic categories of algorithms are used in the sorting system in accordance with the present invention: (1) training algorithms, (2) real-time operation algorithms, and (3) utility algorithms. The training algorithms are used to teach the system to identify the color and grain classes that are to be used during the sorting process. The real-time algorithms actually perform the color and grain sorts with parts moving through the system at the desired throughput rate. The utility algorithms allow operators to display images, perform system tests, etc.

Redundancy in the training algorithm for grain matching is eliminated by removing the effects of varying intensities among the color classes from the output of the edge detectors, using an equal probability quantizing algorithm.

A training sample is one face of an edge-glued panel part considered to be prototypical of the color class to which the face has been assigned. The color sorting training algorithm is performed by analyzing a plurality of training samples, and includes the steps of: collecting a color image of a training sample; applying the shading compensation algorithm to the color image to produce a shading compensated color image; using the shading compensated color image to average the red, green, and blue channel values to form a black and white image; applying a preselected threshold to the black and white image, removing background pixels from further consideration; using the shading compensated color image to compute a three-dimensional color histogram for the training sample, ignoring any background pixels; using the black and white image to compute a black/white histogram for the training sample, again ignoring any background pixels; applying a character mark detection algorithm to the black/white histogram to find a threshold value; removing character mark pixels from the three-dimensional color histogram; normalizing the three-dimensional color histogram to convert it to an estimated probability function; adding the estimated probability function of the training sample to a running sum of three-dimensional estimated probability functions for the color class; also adding the estimated probability function of the training sample to a running sum for all part classes; repeating the above steps for all training samples; applying a color mapping algorithm to the running sum for all part classes to reduce the dimensionality of the color measurement vector and produce a color lookup table; and using the color lookup table to map the estimated probability function for each training sample into a reduced measure vector.

The remaining steps of the algorithm depend upon whether the decision as to color class is based on a single prototype used to represent each class or on a pattern classification method using a k-nearest neighbor classification procedure. Where color class is based on a single prototype, the algorithm includes the remaining steps of: using the color lookup table to map each running sum of three-dimensional estimated probability functions for a color class into a reduced measure vector; determining the prototype for each class based on the reduced measure vector; and for each class estimating the threshold by examining all the training samples for all the classes and selecting the threshold that gives the minimum probability of error.

Where color class is based on a pattern classification method, the algorithm includes the remaining steps of: using the color lookup table to map each estimated probability function into a reduced measure vector; and for each class, estimating the threshold by examining all of the training samples for all the classes and selecting the threshold that gives the best results.

The shading correction algorithm is performed by collecting a selected number of lines of color image data from one of the cameras while the lens cap is on, computing the average response for each pixel in each channel of data, removing the lens cap and scanning the selected number of lines of color image data off the white target, computing the average response for each pixel in each channel of data, and applying the steps of a standard shading correction algorithm to the color imagery as it is being collected.

The character mark detection algorithm accepts as input a black and white histogram of a part face, and outputs a threshold used to eliminate the effects of character mark from the color sorting of the parts.

A color mapping algorithm is used to reduce the size of the measurement vector needed to represent each part face, and also to remove colors that might be character marks from the color class prototypes (if a simple pattern classification algorithm is employed), or from the training samples themselves (if a k-nearest neighbor pattern classification procedure is used), as well as from the two reduced measurement vectors that are used to represent the color of each part face during real-time operation. The color mapping algorithm is based on the Heckbert color mapping algorithm, with additional steps for removing character marks.

The real-time color sorting algorithm has two embodiments, one based on using the distance from class prototype classifier, and the other based on using the k-nearest neighbor algorithm. Both embodiments have in common the steps of: collecting a color image of a sample part face; shade compensating the color image to remove non-uniformitites in light and in sensing element sensitivities across the filed of view; averaging the red, green, and blue components of each color pixel in the shade compensated color image to create a black and white image; applying a threshold to the black and white image to remove background pixels from consideration; computing a reduced measurement vector using the color lookup table; computing a histogram of the black and white image of the part face; applying the character mark algorithm to the histogram; removing character mark pixels from the reduced measurement vector; and normalizing the reduced measurement vector to form the normalized reduced measurement vector.

In the embodiment in which the distance from prototype classifier is used, the algorithm includes the additional steps of: removing character mark colors from each of the prototypes; forming a new set of modified prototypes with the effects of character marks removed from consideration; computing the distance from each of the prototypes; and assigning a color class to the part face based on this distance.

In the embodiment in which the k-nearest neighbor classification rule is used, the algorithm includes the additional steps of: removing character mark colors from each training sample to create a modified measurement vector for the sample; normalizing the modified measurement vector; computing the distance from the modified training sample; finding the k smallest of the distance values; finding the color class label that occurs the most often in the training vectors with the k smallest distances; and assigning the part face to a color class based on the shortest distance.

The real-time color sorting algorithms pass three pieces of information about each part face to the best face selection algorithm: (1) the class label of the color class to which the face has been assigned; (2) a distance measure; and (3) $Area_{clear}$, the clear area of the part face. The best face selection algorithm then uses this information to determine which of the two faces is the best face.

Training for grain matching is done independently of the training that is done for color sorting, because the grain matching operation requires only black and white imagery. However, the grain matching training procedure shares a number of common steps with the training used for color matching. The grain matching training algorithm is performed by analyzing a plurality of training samples, and includes the steps of: collecting a color image of a training sample; applying the shading compensation algorithm to the color image to remove non-uniformities in lighting and in camera sensing element sensitivities across the field of view to produce a shading compensated color image; using the shading compensated color image to average the red, green, and blue channel values to form a black and white image; applying a preselected threshold to the black and white image, removing background pixels from further consideration; using the black and white image to compute a black/white histogram for the part face, ignoring any background pixels; applying a character mark algorithm to the black/white histogram to find the threshold value; removing character mark pixels from the black/white histogram; removing character mark areas from further consideration by labeling them as background pixels; computing the normalizing factor; applying the equal probability quantizing algorithm to the black and white image of the part, the black/white histogram, the normalizing factor, and the number of gray levels appearing in the requantized black and white image to obtain a requantized version of the black and white image; applying the edge detectors respectively most sensitive to the vertical, horizontal, right diagonal, and left diagonal edges to the requantized version of the black and white image to obtain the gradient images which record the absolute values of, respectively, the vertical, horizontal, right diagonal, and left diagonal edges; averaging the left and right diagonal gradient images to find a single gradient image that indicates the number of diagonal edges present in either the right or left diagonal dimensions; and creating an edge histogram and normalizing it.

The remaining steps of the algorithm depend upon whether the decision as to grain class is based on a single prototype used to represent each class or on a pattern classification method using a k-nearest neighbor classification procedure. Where grain class is based on a single prototype, the algorithm includes the remaining steps of: finding the class prototype for each class; and for each class estimating the threshold by examining all the training samples for all the classes and selecting the threshold that gives the minimum probability of error.

Where grain class is based on a pattern classification method, the algorithm includes the remaining step of estimating the threshold for each class by examining all the training samples for all the classes and selecting the threshold that gives the best results.

The real-time grain sorting algorithms are performed after both part faces have been color sorted, and after the best face of the part has been selected. As with the real-time color sorting algorithm, the real-time grain sorting algorithm has two embodiments, one based on using the distance from class prototype classifier, and the other based on using the k-nearest neighbor algorithm. Both embodiments have in common the steps of: removing character mark pixels from the black and white histogram of the best part face; removing character mark areas from further consideration by labeling them as background pixels in the black and white image of the best part face; computing the normalizing factor; applying the equal probability quantizing algorithm to the black and white image of the best part face, the black/white histogram of the black and white image of the best part face, the normalizing factor, and the number of gray levels appearing in the requantized black and white image to obtain a requantized version of the black and white image; applying edge detectors respectively most sensitive to the vertical, horizontal, right diagonal, and left diagonal edges to the requantized version of the black and white image to obtain the gradient images which record the absolute values of, respectively, the vertical, horizontal, right diagonal, and left diagonal edges; averaging the left and right diagonal gradient images to find a single gradient image that indicates the number of diagonal edges present in either the right or left diagonal dimensions; and creating an edge histogram and normalizing it.

In the embodiment in which the distance from prototype classifier is used, the algorithm includes the additional steps of: computing the distance from each of the prototypes; and assigning a grain pattern class to the part face based on the distance.

In the embodiment in which the k-nearest neighbor classification rule is used, the algorithm includes the additional steps of: computing the distance from the training sample; finding the k smallest of the distance values; finding the grain class label that occurs the most often in the training vectors with the k smallest distances; and assigning the part face to a grain class based on the shortest distance.

An algorithm for normalizing variations in sensitivity between the two cameras is also provided, so that both cameras are equally sensitive to each color, and the response of both cameras is the same for each color. The normalizing algorithm uses ten to fifteen color samples spanning the intensity levels that the cameras have been set up to handle, and includes the steps of: for each color sample, scanning the color sample to collect a color image of the sample from both cameras, applying the shading correction algorithm to the color images from both cameras, and computing the values of matrices representing the relative red, green, and blue responses of the two cameras based on the shading corrected color component images collected from both cameras; creating a two-dimensional plot of the relative red responses of the two cameras to all of the color targets, with the horizontal axis representing the output gray level value for the red channel of the first camera and the vertical axis representing the output gray level value for the red channel of the second camera; creating a two-dimensional plot of the relative green responses of the two cameras to all of the color targets, with the horizontal axis representing the output gray level value for the green channel of the first camera and the vertical axis representing the output gray level value for the green channel of the second camera; creating a two-dimensional plot of the relative blue responses of the two cameras to all of the color targets, with the horizontal axis representing the output gray level value for the blue channel of the first camera and the vertical axis representing the output gray level value for the blue channel of the second camera; determining if the function y=x is the function that best fits the points on all three of the red, green, and blue plots; if y=x provides the best fit, terminating execution of the normalizing algorithm, as adjustment in either camera output is unneeded; otherwise, estimating the degree of polynomial function that appears to best fit the relative response data; defining a function for each graph that fits the data, using a least squares fitting program; and creating three lookup tables that map the output of the first camera into the output of the second camera.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
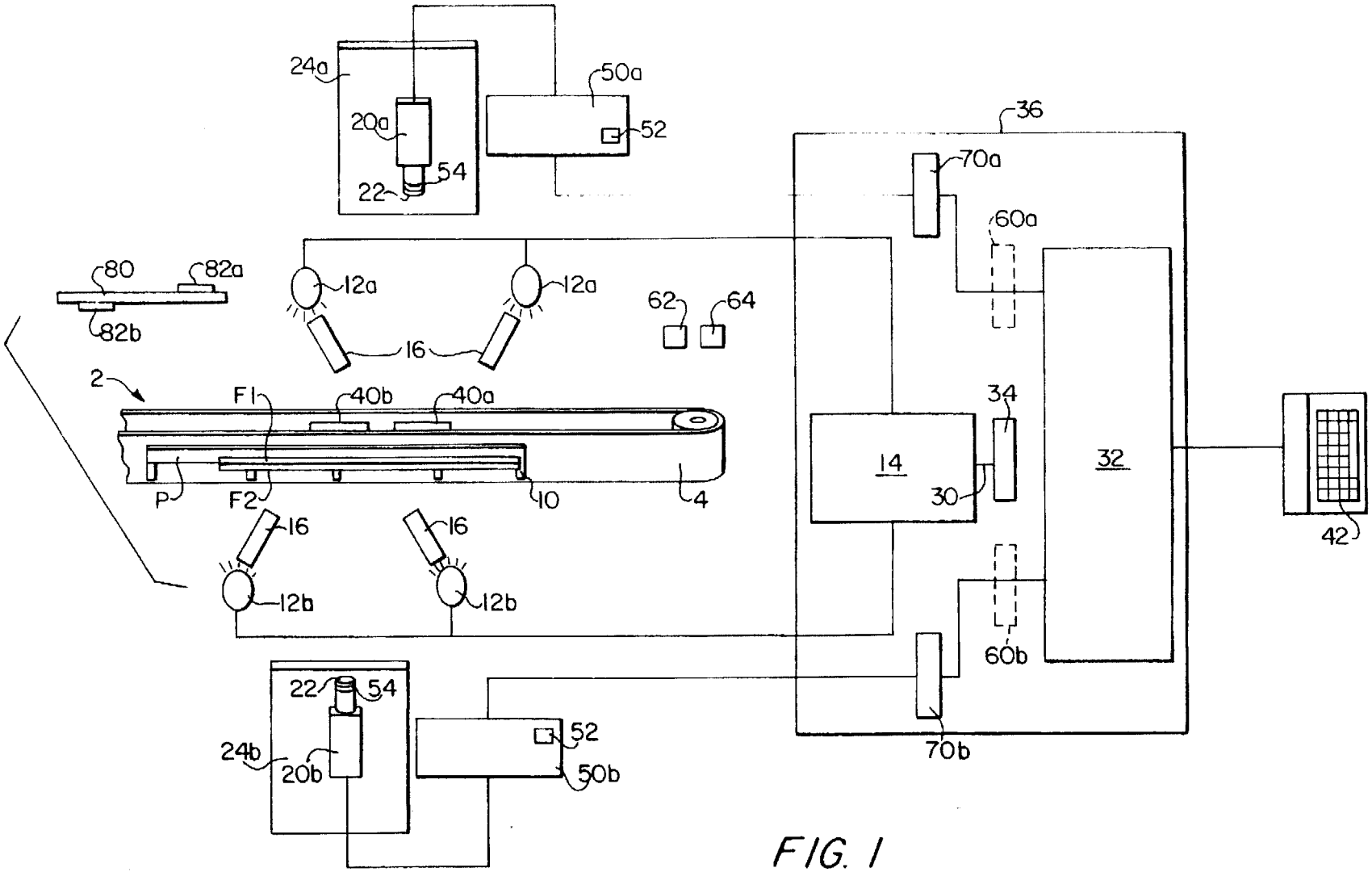
FIG. 1 is a diagrammatic view of apparatus for the color and grain sorting of a hardwood part, in accordance with the present invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Referring now to FIGS. 1, 2, 3A, and 3B, there is shown the apparatus for carrying out the system in accordance with one embodiment of the present invention in connection with the color and grain sorting of hardwood edge-glued parts, so that panels of uniform color and grain pattern can be created. As will be appreciated by those of skill in the art, and as described hereinafter, the apparatus can be varied depending on, among other things, the material being color and/or grain sorted.

Figure 2:
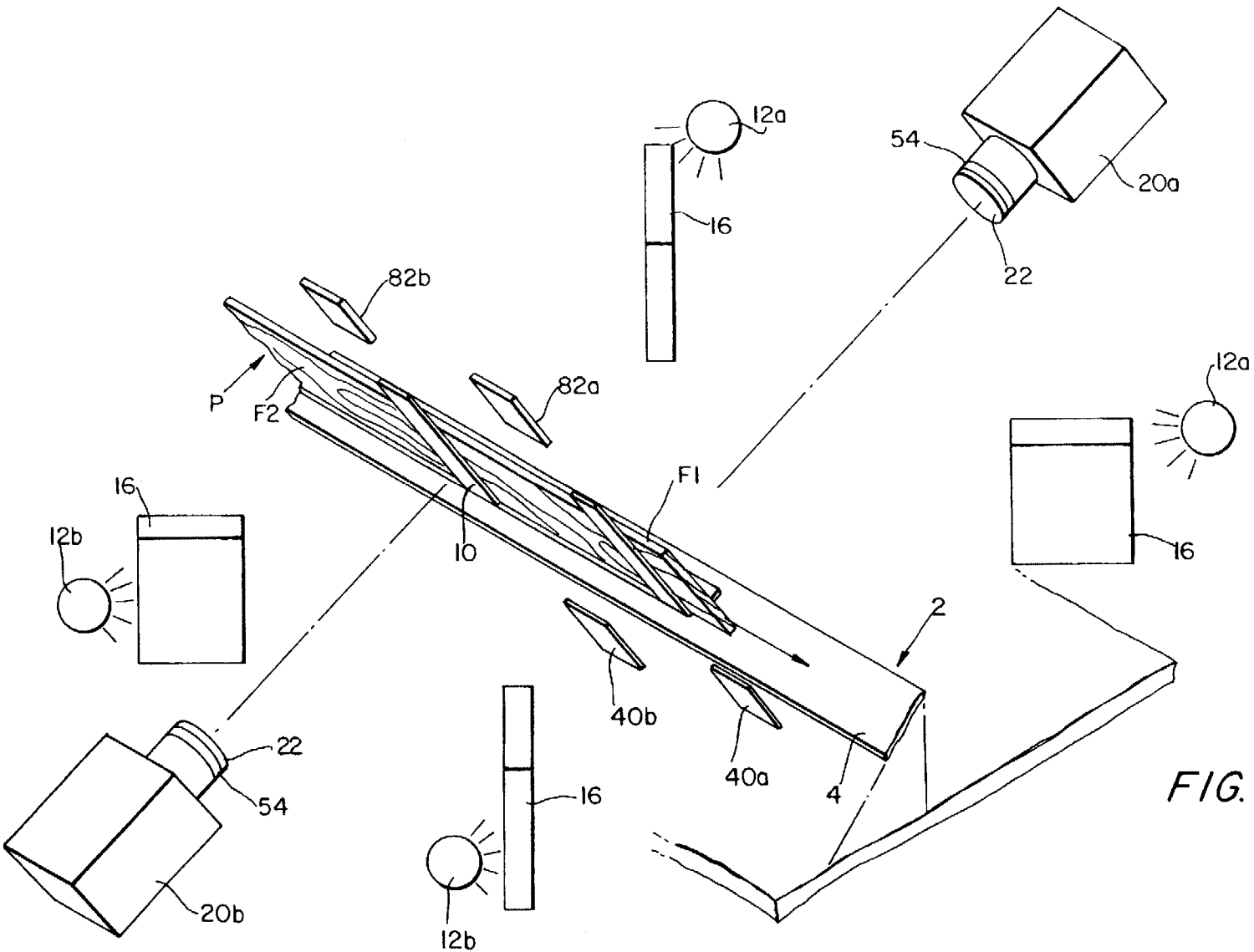
FIG. 2 is a top perspective view of the conveyor, illumination, and imaging elements of the apparatus of FIG. 1.

The apparatus as shown in FIGS. 1–3 includes a materials conveyor 2 for moving a hardwood part P having first and second opposite faces F1 and F2 to be color and grain sorted. Hardwood part P is positioned on driving belt 4 of conveyor 2 supported at an angle of between approximately 70° to approximately 80° by a support fence 10, with face F1 facing away from support fence 10 (and henceforth referred to as the top face) and face F2 facing toward support fence 10 (and henceforth referred to as the bottom face), for a purpose to be described hereinafter. Hardwood part P is propelled by friction between its bottom edge and belt 4.

Hardwood part P is illuminated by top and bottom sets of quartz tungsten halogen lamps 12*a* and 12*b* positioned to illuminate the top and bottom faces, F1 and F2, respectively. DC power for quartz tungsten halogen lamps 12*a* and 12*b* comes from a single switching power supply 14. Top and bottom sets of lamps 12*a* and 12*b* are horizontally offset from each other in a plane lying at an angle to belt 4, to illuminate opposite faces F1 and F2 of part P at different positions on conveyor 2.

In one embodiment of the present invention, quartz tungsten halogen lamps 12*a* and 12*b* do not directly illuminate faces F1 and F2 of edge glued panel part P. Rather, the light emitted from lamps 12*a* and 12*b* is sent through fiber optic light lines 16. Faces F1 and F2 are illuminated by the light emitted from lines 16. There are several reasons for using lines 16, including, but not limited to, removing the lamps 12*a* and 12*b* from the area to be illuminated, so they will not heat the cameras; providing bright and even light over the length of the camera scan line; and facilitating changing a lamp in case it burns out. If a lamp burns out, both it and its enclosure can be easily removed without waiting for the lamp to cool. In another embodiment of the present invention, lamps 12*a* and 12*b* directly illuminate faces F1 and F2 of part P.

A pair of color CCD line scan cameras 20*a* and 20*b* are positioned above and below top and bottom faces F1 and F2 to view them respectively. Each color camera 20*a* and 20*b* has a field of view larger than the hardwood part P, so that the hardwood part P only passes through a portion or area of the field of view.

Like lamps 12*a* and 12*b*, the optical axes of top and bottom cameras 20*a* and 20*b* are offset from each other horizontally and lie in a plane at an angle to the horizontal. The optical axes are parallel to each other and perpendicular to fence 10 (and hence, to faces F1 and F2 of part P), and both intersect fence 10 at a point approximately one (1) inch (2.54 cm) above drive belt 4. Edge glued panel parts are always at least one inch wide. Locating the optical axes one inch above drive belt 4 prevents top and bottom cameras 20*a* and 20*b* from imaging the top edge of hardwood part P as well as top and bottom faces F1 and F2.

In order to achieve the accuracy necessary for color and grain sorting, it is imperative that the lenses of cameras 20*a* and 20*b* be kept clear of dust and other debris. Hardwood part P and cameras 20*a* and 20*b* are set at an angle as described above, to avoid either of cameras 20*a* and 20*b* from having to be located under part P as it is being imaged. Locating a camera below an area where part P traverses will result in dust, saw dust, and other debris falling off a part and onto the lens of the camera below.

Color CCD line scan cameras are used because they provide a convenient method for handling parts of different lengths and they also provide a method for independently controlling both the cross part and down part spatial resolutions. Each color camera 20*a* and 20*b* has the appropriate infrared cutoff filter 22 (FIG. 2) so that the sensitive locations on the CCD only respond to light in the visible range. To reduce the amount of dark current produced by each of cameras 20*a* and 20*b*, they are contained in cooled enclosures 24*a* and 24*b* (FIG. 1). The cooling assures that cameras 20*a* and 20*b* operate at a constant temperature, preferably less than or equal to 70°.

Referring to FIG. 1, power supply 14 provides DC power to lamps 12*a* and 12*b* so that the color images obtained from color cameras 20*a* and 20*b* do not have stripping caused lighting variations induced by AC power. Power supply 14 has a single input line 30 that is used to control how much power is supplied to each of lamps 12*a* and 12*b*. By supplying the power to each of lamps 12*a* and 12*b* over a single input line 30, lamps 12*a* and 12*b* can be controlled simultaneously and uniformly. The power supplied depends on the voltage presented on the input line 30. A computer 32 controls the voltage on input line 30 using a digital-to-analog converter 34. To improve the reliability of computer 32 and the stability of the power provided to the quartz tungsten halogen lamps 12*a* and 12*b*, computer 32 and the switching power supply 14 are both enclosed in a dust free enclosure 36 that is air-conditioned to maintain a steady operating temperature.

The amount of voltage supplied to lamps 12*a* and 12*b* is based on an examination of a first target 40*a* appearing in the field of view of camera 20*a*. Although first target 40*a* appears in the field of view of camera 20*a*, it appears outside the area through which part P passes.

The picture elements (pixels) of the viewing camera (i.e., camera 20*a*) that cover an area of first target 40*a* are averaged. This average is compared by computer 32 to a standard stored in the memory of computer 32. If the average is slightly below the standard, more voltage is applied to line 30 to switching power supply 14. This causes power supply 14 to increase the voltage supplied to all the quartz tungsten halogen lamps 12*a* and 12*b*. If the computed average is slightly above the standard, computer 32 reduces the voltage on line 30 to power supply 14. This causes the power supply to decrease the amount of power supplied to all the quartz tungsten halogen lamps 12*a* and 12*b*. If the average is markedly different from the standard, system operation is halted and an alarm is displayed on the system console 42 to inform operators that a lamp has burned outt or that the shading compensation values need to be recalculated.

A second target 40*b* similar to target 40*a* appears in the field of view of camera 20*b*, also outside the area through which part P passes. Pixels from camera 20*b* that cover an area of second target 40*b* are also averaged. If the value of this average is markedly different from the standard, system operation is halted and an alarm is displayed on system console 42 to inform operators that a lamp has burned out or that the shading compensation values need to be recalculated.

Preferably, targets 40*a* and 40*b* are ceramic, and are white, although they can also be some shade of gray, or other colors.

First and second camera controllers 50*a* and 50*b* accept analog data from the heads of cameras 20*a* and 20*b*, respectively, and digitize it so that the data can be passed to computer 32 for analysis. In one embodiment of this invention, each controller 50*a* and 50*b* uses a single analog to digital (A/D) converter 52. Hence the same gain and offset are used for the red, green, and blue pixels. If this is the situation then blue filters 54 must be used on cameras 20*a* and 20*b*. Blue filters 54 (FIG. 2) assure that red, green, and blue values will be reasonably close when shading corrections are made, as described hereinafter.

In a preferred embodiment, three different A/D converters 52 are used, each having its own offset and gain. This removes the need for blue filters 54. Removing blue filters 54 markedly increases the amount of light reaching the heads of cameras 20*a* and 20*b*. With more light reaching the camera heads, either fewer or less intense lamps 12*a* and 12*b* can be used. Because less intense lamps typically have longer expected lifetimes, their use can markedly reduce routine maintenance requirements.

In one embodiment of the invention, the color image data coming from cameras 20*a* and 20*b* are directly transferred to computer 32 using direct memory access (DMA) computer interfaces 60*a* and 60*b*. The use of interfaces 60*a* and 60*b* allows image data to be placed in computer memory without the need for the computer's central processing unit to have to perform any functions. Computer 32 is thus allowed to process image data from a previously-viewed part P while image data from the next part P is being collected.

If the data from cameras 20*a* and 20*b* are fed directly into computer 32, then two additional hardware components prove useful. These are an optical sensor 62 for determining when a part P is about to enter the field of view of cameras 20*a* and 20*b* and an ultrasonic width sensor 64 for determining the width of the entering part P. Optical sensor 62 is used to turn cameras 20*a* and 20*b* on and off. Ultrasonic sensor 64 is used to determine the number of pixels on each of CCD cameras 20*a* and 20*b* that must be read The goal of both these sensors 62 and 64 is to minimize the amount of data that is collected and must be analyzed.

In a preferred embodiment of the invention, data from color cameras 20*a* and 20*b* is first passed through high speed processing boards 70*a* and 70*b* that perform certain operations on the image data. The data processed by processing boards 70*a* and 70*b* are then passed to computer 32 via DMA interfaces 60*a* and 60*b*. The use of processing boards 70*a* and 70*b* allows the system in accordance with the present invention to have significantly higher throughput. In this embodiment, the determination of the width and the location of the leading and lagging edge of a part P is determined by the high speed processing boards 70*a* and 70*b*. Therefore, no sensors are provided, cameras 20*a* and 20*b* stay on all of the time, and the processing boards 70*a* and 70*b* only send data to the computer 32 for the pixels representing the part P. All other pixels are deleted by the processing boards 70*a* and 70*b*.

Figure 3A:
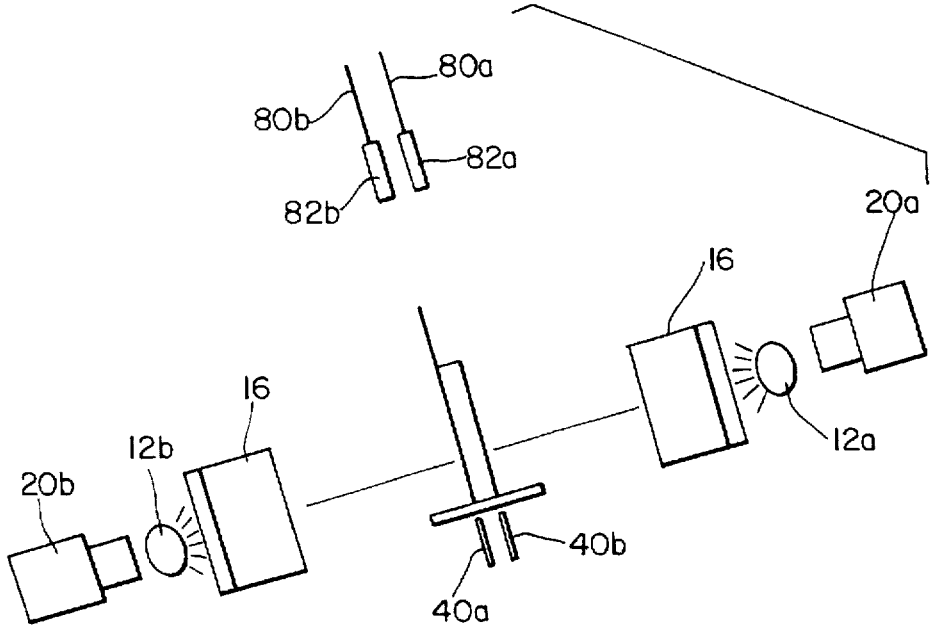
FIG. 3A is a side elevational view of the conveyor, illumination, and imaging elements of FIG. 2, in which the targets used for shading compensation are placed in the camera fields of view by pneumatic devices.
Figure 3B:
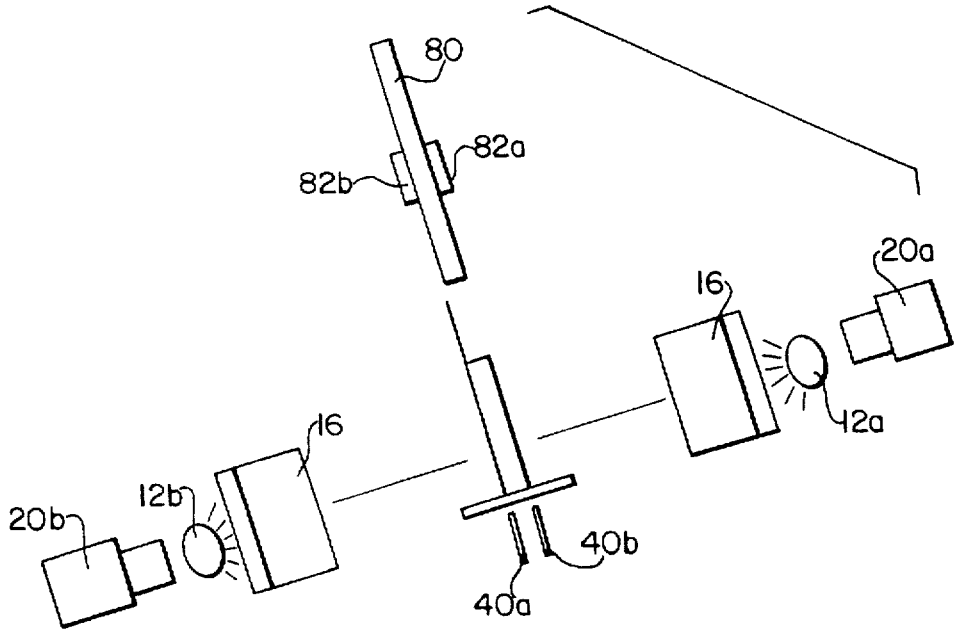
FIG. 3B is a side elevational view of the conveyor, illumination, and imaging elements of FIG. 2, in which the targets used for shading compensation are transported to the camera fields of view by a carrier moved by the conveyor.

As shown in FIG. 3A, a pair of pneumatic devices 80*a* and 80*b* controlled by computer 32 provide the capability of selectively inserting targets 82*a* and 82*b*, respectively, into the fields of view of cameras 20*a* and 20*b*, respectively, where the panel parts P pass through. Alternatively, as shown in FIG. 3B, a board 80 having targets 82*a* and 82*b* set into its faces can selectively be placed on the conveyor 2 for use in shading compensation. Targets 82*a* and 82*b* can, for example, be set into grooves routed in the faces of board 80 and are positioned on board 80 so that when board 80 is placed on conveyor 2 in the proper location, targets 82*a* and 82*b* are in the scan lines for cameras 20*a* and 20*b*, respectively, where the edge glued panel parts P pass through. In either case, targets 82*a* and 82*b* have faces which lie in the same plane as faces F1 and F2 will lie when part P is being scanned, and should be "whiter" than any part P that will be inspected.

For those implementations of the present invention which require the most sensitivity, targets 82*a* and 82*b* should have a reflectivity which substantially matches that of the faces F1 and F2 of the edge glued panel parts P being inspected. For implementations requiring less sensitivity, targets having a reflectance of 99% are adequate, as a reflectance of 99% will encompass almost any article being examined. Targets 82*a* and 82*b* preferably are white ceramic tiles which are uniform in color across their surfaces. Targets 82*a* and 82*b* can also be some shade of gray, but must be equally reflective at each color channel of cameras 20*a* and 20*b*.

Targets 82*a* and 82*b* allow computer 32 to collect the data needed to do "shading compensation" on the collected color image data. The shading compensation algorithm is used to remove any variations in lighting that occur across the fields of view of cameras 20*a* and 20*b*. It also removes the variations in sensitivity across the sensitive elements of the CCD cameras 20*a* and 20*b*.

In one embodiment of the present invention, the shading compensation is done only on the digitized imagery. In a preferred embodiment, a "rough" analog shading correction is performed by camera controllers 50*a* and 50*b* prior to the A/D conversion of the color imagery by A/D converters 52. After conversion, another "fine" shading correction is performed on the digital imagery. The rough analog shading correction is performed by controlling the offset and gain for each pixel going into each A/D converter 52.

Additionally, it is necessary to provide a means of identifying the color class of the parts P. In one embodiment of the present invention, an ink jet printer or the like (not shown) is positioned to spray onto the parts P a code indicating the color code and the best face of each part P. In a preferred embodiment, conveyor 2 is extended, and provided with a plurality of pneumatically-operated kick-off assemblies (not shown) which sort the parts P into bins (also not shown).

Overview of the processing algorithms

The algorithms used in the system can be broken down into three basic categories: (1) training algorithms, (2) real-time operation algorithms, and (3) utility algorithms. The training algorithms are used to teach the system to identify the color and grain classes that are to be used during the sorting process. The real-time algorithms actually perform the color and grain sorts with parts moving through the system at the desired throughput rate. The utility algorithms allow operators to display images, perform system tests, etc. As will be appreciated by those of skill in the art, the number and type of utility algorithms can and will vary slightly with each device that is produced, in a manner which will be understood by those of skill in the art. Also these utility algorithms are used only for checks and are unrelated to the uniqueness of the present invention. Hence, only the training and real-time implementation algorithms will be described herein.

As might be expected, many of the same basic procedures appear in both the training and real-time implementation modes of operation. In these instances, common algorithms will only be described once herein.

The equal probability quantizing algorithm

There may be significant intensity differences among the color classes. This difference can and will affect the output of edge operators. To achieve the best grain sorting accuracies therefore would appear to require establishing different grain sorting training samples for each color class, an operation that is labor intensive.

One of the objects of the present invention is to eliminate this "redundant" training by removing the effects of varying intensities among the color classes from the output of the edge detectors used. A relatively standard procedure for removing the differences in intensities across the training samples is to use the equal probability quantizing (EPQ) algorithm as described by R. Conners and C. Harlow, 1978, "Equal Probability Quantizing and Texture Analysis of Radiographic Images," 8 *Computer Graphics and Image Processing* (1978), pp. 447–463. This algorithm is as follows:

1. Let Part=$F_{total}$/NGL, Lookup(0)=0, Start=1 and let i=0.
2. For l=1 to NGL perform the following:
   a. Let Sum=0.
   b. Until Sum≧Part let i=i+1 and Sum=Sum+$h_{BW}$(i).
   c. Let Check=Sum)−$h_{BW}$(i−1).
   d. If |Part−Sum|≦|Part−Check| let Finish=i. Otherwise, let Finish=i−1.
   e. For k=Start, . . . , Finish let Lookup(k)=l.
   f. Let Start=Finish+1.
   g. Go to Step a.
3. Requantize BW, i.e., for all x and y such that bw(x, y)≠0 let $$bw(x, y)=\text{Lookup}(bw(x, y)).$$

System color sorting training algorithms

Suppose the N color classes have been selected for the sort. Let the matrix $M_{samples}=[m_{samples}(n)]$ give the number of training samples available in each of the N classes. A training sample is one face of an edge-glued panel part. This face represents what is considered to be a prototypical example of the color class to which the face has been assigned. To perform system training the selected parts are all run through the system with their selected faces up.

The training algorithm is as follows:

1. For n=1, . . . . N and m=1, . . . . $m_{samples}(n)$ do the following:
   a. Collect a color image, $CI_{nm}$, of the $m^{th}$ training sample of class n.
      $CI_{nm}$ is composed of three matrices, $R_{mn}=[r_{nm}(x,y,)]$, $G_{nm}=[g_{nm}(x,y)]$, and $B_{mn}=[b_{nm}(x,y)]$ that represent the red, green, and blue components respectively.
   b. Apply a color shading compensation algorithm, to be described hereinafter, to $CI_{nm}$, to remove nonuniformities in lighting and in camera sensing element sensitivities across the field of view, to produce a shading compensated color image $SCI_{nm}$. As described above, $SCI_{nm}$ is composed of three matrices, $SR_{mn}=[sr_{mn}=[sr_{nm}(x,y)]$, $SG_{nm}=[sg_{nm}(x,y)]$, and $SB_{mn}=[sb_{nm}(x,y)]$.
   c. Using $SCI_{nm}$ average the red, green, and blue channel values to form a black and white image, $BW_{mn}=[bw_{nm}(x,y)]$, i.e., for all x and y let $$bw_{nm}(x,y)=(sr_{mn}(x,y)+sg_{nm}(x,y)+sb_{nm}(x,y))/3.$$

d. Apply a preselected threshold, $T_{background}$, to the black and white image $BW_{nm}$ removing background pixels from further consideration, i.e., for all x and y let $$bw_{nm}(x,y)=0$$

if $bw_{nm}(x,y)\leqq T_{threshold}$.

e. Using $SCI_{nm}$ compute the three-dimensional color histogram $H_{nm}=[h_{nm}(i, j, k)]$ for this part face, ignoring any background pixels as found in Step d. That is, for all x and y such that bw(x, y)≠0 let $$h_{nm}(sr_{nm}(x, y), sg_{nm}(x, y), sb_{nm}(x, y))=_{nm}(sr_{nm}(x, y), sg_{nm}(x, y), sb_{nm}(x, y))+1.$$

f. Using $BW_{nm}$ compute the black/white histogram $H_{BW}=[h_{BW}(i)]$ for this part face, again ignoring any background pixels. That is for all x and y, such that bw(x,y)≠0 let $$h_{BW}(bw(x,y))=h_{BW}(bw(x,y))+1.$$

g. Apply the character mark algorithm to the black/white histogram, $H_{BW}$, to find the threshold $T_{CM}$.
   h. Remove character mark pixels from the three-dimensional color histogram Hnm=$[h_{nm}(i, j, k)]$, i.e., for all (i, j, k) set $$h_{nm}(i, j, k)=0.$$

if (i+j+k)/3≦$T_{CM}$.

i. Normalize three-dimensional color histogram $H_{nm}$ to turn it into an estimated probability function $P_{nm}=[p_{nm}(i, j, k)]$ by dividing each $h_{nm}(i, j, k)$ by the normalizing factor $$F_{total} = \sum_i \sum_j \sum_k h_{nm}(i,j,k).$$

j. Add the estimated probability function of this part face, $P_{nm}=[p_{nm}(i, j, k)]$, to the running sum $S_n=[s_n(i, j, k)]$, of three-dimensional estimated probability functions for color class n, i.e. for all i, j, and k let $$s_n(i, j, k)+s_n(i, j, k)+p_{nm}(i, j, k).$$

k. Also add $P_{nm}$ to the running sum $S=[s(i, j, k)]$, for all part classes, i.e., for all i, j, and k let $$s(i, j, k)=s(i, j, k)+p_{nm}(i, j, k).$$

2. Apply the color mapping algorithm to S. This algorithm effectively reduces the dimensionality of the color measurement vector. The output of this algorithm is a color lookup table $CM_{lookup}=[cm_{lookup}(i, j, k)]$. This algorithm also outputs a lookup table $MS_{lookup}=[ms_{lookup}(t)]$. This lookup table will be defined below in the subsection describing the color mapping algorithm.
3. Use $C_{lookup}$ to map each $P_{nm}=[p_{nm}(i, j, k)]$, n=1, . . . , N and m=1, . . . , $m_{samples}(n)$ into a reduced measure vector $CMV_{nm}=[cmv_{nm}(l)]$ using $$cmv_{nm}(l) = \sum_{i,j,k \mid C_{lookup}(i,j,k)=l} \sum P_{nm}(i,j,k),$$

where for each n, n=1, . . . , N, and each m, m=1, . . . , $m_{samples}(n)$ $$\sum_l cmv_{nm}(l) = 1.0.$$

In an actual implementation, the steps stated above would not necessarily be performed in the exact order set forth herein. By combining certain operations together in a known manner, computational efficiencies can be achieved. The above steps are believed to represent the simplest conceptualization for describing the processing.

Note that the color histograms, $H_{nm}=[h_{nm}(i, j, k)]$, created in Step 1, Part e of the color sorting training algorithm are not 256×256×256 but rather 64×64×64. This reduction markedly reduces the storage requirements needed to form and store this data.

In addition to the above steps other steps must be performed as well. However, these remaining steps depend on which embodiment of the device is being used. Two different embodiments are possible. They differ depending on the methods used for making the decision as to which color class a particular part face belongs. In one embodiment of this aspect of the invention, a single prototype is used to represent each class. In this embodiment a part face is assigned to a class based on the distance its color measurement vector is from the various class prototypes. The prototype that produces the minimum distance is the class to which the part face is assigned given that this distance is less than some specified threshold. Using these thresholds provides the capability of having an out class. A part face is assigned to the out class if it lies too far away from the prototype of the class to which it has been assigned. This distance from class prototype color sorting method is useful if the parts in each class have a very uniform color.

The steps involved in the embodiment are as follows:

4. Use $C_{lookup}$ to map each $S_n$, n=1, . . . , N, into a reduced measure vector $Pr_n=[pr_n(l)]$ using $$pr_n(l) = \sum_{i,j,k \mid C_{lookup}(i,j,k)=l} \sum s_n(i,j,k).$$

5. For each n, n=1, . . . , N, perform the following operations:
   a. Find $F_n$ using $$F_n = \sum_l pr_n(l)$$

b. Then for all l let $$pr_n(l)=pr_n(l)/F_n$$

so that $$F_n = \sum_l pr_n(l) = 1.0.$$

The resulting $Pr_n=[pr_n(l)]$ is the prototype for class n.

6. For each class n, n=1, . . . , N estimate the threshold $T_n$ by examining all the training samples, $CMV_{nm}=[cmv_{nm}(l)]$ for all the classes and selecting $T_n$ that gives the minimum probability of error.

A second embodiment of this aspect of the invention uses the k-nearest neighbor classification procedure, as described by R. Duda and P. Hart in *Pattern Classification and Scene Analysis* (John Wiley, New York 1973). This pattern classification method is useful if one or more of the color classes is made up of parts that have a variety of different colors. This method for color sorting parts is much more computationally complex than the method described above and hence should only be used when one or more of the color classes contain parts that have a variety of different colors. To use this classification method the measurement vector from each sample in each color class must be saved in computer memory. The measurement vector used to characterize the color of a part face is computed. The distance from this measurement vector to each of the measurement vectors computed from each of the training samples is determined. The k measurement vectors of the training samples that are the closest to the one computed from the part face are then found. The part face is assigned to the class to which the most of the k-nearest training sample measurement vectors belong. To provide for an out class the distance between the part face's measurement vector and the closest training sample in the class to which the part face has been assigned is compared to a threshold value. If this distance is less than or equal to the threshold value, the part face's classification remains unchanged. If, however, this distance is greater than the threshold value, the part face's classification is changed to the out class. The steps needed to implement this embodiment of the training algorithm is as follows:

4'. Use $C_{lookup}$ to map each $P_{nm}$, n=1, . . . , N, and m=1, . . . , $m_{samples}(n)$ into a reduced measure vector $CMV_n=[cmv_{nm}(l)]$ using $$cmv_{nm}(l) = \sum_{i,j,k \mid C_{lookup}(i,j,k)=l} \sum P_{nm}(i,j,k).$$

Note that for each n, n=1, . . . , N, and each m, m=1, . . . , $m_{samples}(n)$ $$\sum_l cmv_{nm}(l) = 1.0.$$

5'. For each class n, n=1, . . . , N estimate the threshold $T_n$ by examining all the training samples, $CMV_{nm}$ for all the classes and selecting $T_n$ that gives the best results.

The results of the training algorithm are stored in disk files that are read by the systems real-time operation algorithm when it is started up. In this way training files for a number of different species can be created and stored on disk. This allows the system to handle a variety of different species. The appropriate training files for the species to be processed only need be loaded into the real-time algorithm at the time it is started up.

Finally, the quantities $T_n$ defined in either Step 6 or in Step 5', depending on the classification method being used, are only approximations to the actual values for these thresholds. This follows from the fact that under typical training conditions only a very limited number of training samples are used. Plant personnel can change these values after the training is performed. These parameters provide the mechanism for plant personnel to change the uniformity of the sort. If a $T_n$ is made small then all the parts sorted into a color class n will have approximately the same color. If $T_n$ is made larger then parts with more diverse colors will be sorted into a color class. Having a separate parameter for each color class allows optimal control of the sorting process.

The Shading Correction Algorithm

The purpose of the shading correction algorithm is to remove nonuniformities in lighting and/or sensitivity of sensing elements across a camera's field of view. A standard shading correction algorithm as described by A. Sawchuk, 1977, "Real-time Correction of Intensity Nonlinearities in Imaging System," *IEEE Transactions on Computers*, Vol. 26, No. 1 (1977), pp. 34–39, is employed in this invention. Since color line scan cameras are being used, the description given will be for such cameras, though the methodologies used can be employed on array cameras as well, as will be understood by those of skill in the art.

To perform shading correction certain data must be collected prior to applying the algorithm to color image data during scanning. The data that must be collected and the initial processing steps that must be applied to these data are as follows:

1. Put the lens cap on the camera lens to prevent any light from entering the camera body.
2. While the lens cap is attached collect a number of lines of color image data. Assume that K lines of data are collected. Let $R_k=[r_k(i)]$, $G_k=[g_k(i)]$, and $B_k=[b_k(i)]$ denote the red, green, and blue components of the kth line collected where $1 \leqq k \leqq K$.
3. Compute the average response for each pixel in each channel of data, i.e., compute $$b_{red}(i) = \sum_{k=1}^{K} r_k(i)/K$$

$$b_{green}(i) = \sum_{k=1}^{K} g_k(i)/K$$

$$b_{blue}(i) = \sum_{k=1}^{K} b_k(i)/K$$

where by convention $B_{red}=[b_{red}(i)]$, $B_{green}=[b_{green}(i)]$, and $B_{blue}=[b_{blue}(i)]$. This averaging helps reduce the effect of thermal noise on the information that will be used to do the shading correction.

4. Remove the lens cap and scan K lines of color image data off a white target whose face lies in the same plane as a part face would be during scanning of the part. Let $R_k=[r_k(i)]$, $G_k=[g_k(i)]$, and $B_k=[b_k(i)]$ denote the red, green, and blue components of the $k^{th}$ line collected where $1 \leqq k \leqq K$.
5. Compute the average response for each pixel in each channel of data, i.e., compute $$w_{red}(i) = \sum_{k=1}^{K} r_k(i)/K$$

$$w_{green}(i) = \sum_{k=1}^{K} g_k(i)/K$$

$$w_{blue}(i) = \sum_{k=1}^{K} b_k(i)/K$$

where by convention $W_{red}=[w_{red}(i)]$, $W_{green}=[w_{green}(i)]$, and $W_{blue}=[w_{blue}(i)]$. Again the averaging is used to reduce the effect of noise on the data that will be used in the actual shading correction processing.

Once the above data collection and data processing operations have been performed, shading correction can be applied to color imagery as it is being collected. The procedure is as follows:

1'. Collect a line of digital color imagery from a color line scan camera. Let R=[r(i)], G=[g(i)], and B=[r(i)] denote the red, green, and blue components of this line of data.

2'. For each element i of this line of data compute $$r_{corrected}(i) = \frac{255 \times (r(i) - b_{red}(i))}{w_{red}(i) - b_{red}(i)}$$

$$g_{corrected}(i) = \frac{255 \times (g(i) - b_{green}(i))}{w_{green}(i) - b_{green}(i)}$$

$$b_{corrected}(i) = \frac{255 \times (b(i) - b_{blue}(i))}{w_{blue}(i) - b_{blue}(i)}$$

The data $R_{corrected}=[r_{corrected}(i)]$, $G_{corrected}=[g_{corrected}(i)]$, and $B_{corrected}=[b_{corrected}(i)]$ represent the red, green, and blue components of the shading corrected line of color data.

The above represents an all-digital way to shade compensate color image data. The all-digital method is used in one embodiment of this aspect of the invention. In a preferred embodiment, shading correction is performed as a two step process. First, there is a rough analog correction. This analog correction is based on the digital processing described immediately above in Steps 1 through 4. This information is then used to control the offset and gain on analog-to-digital (A/D) converters 52 found in the camera controller 50*a* or 50*b*. In this mode of operation there are three A/D converters 52 used, one each for the red, green, and blue color channels. The offset and gain to each converter 52 is varied as a function of i just as is done in the all-digital algorithm that is described above. Once the rough analog shading correction is done, then the purely digital method is applied as a second step. Only after the analog method is running can Steps 1 through 4 be performed to create the coefficients for the purely digital algorithm.

This variation has a number of advantages. First, it gets rid of the blue color filters that are needed to adjust camera sensitivity. Removing the blue filters greatly increases the amount of light that reaches the camera for any setting of light source intensity. Hence, lower power bulbs can be used thus increasing bulb life. Secondly, the combined analog/digital processing greatly reduces the data loss that can occur in purely digital processing when lighting intensity varies significantly over the field of view.

Algorithm for Identifying Character Marks

The character mark algorithm accepts as input a black and white (B/W) histogram, $H_{BW}=[h_{BW}(i)]$, of a part face. It outputs a threshold $T_{CM}$. This threshold is used to eliminate the effects of character marks from the color sorting of parts.

Figure 4:
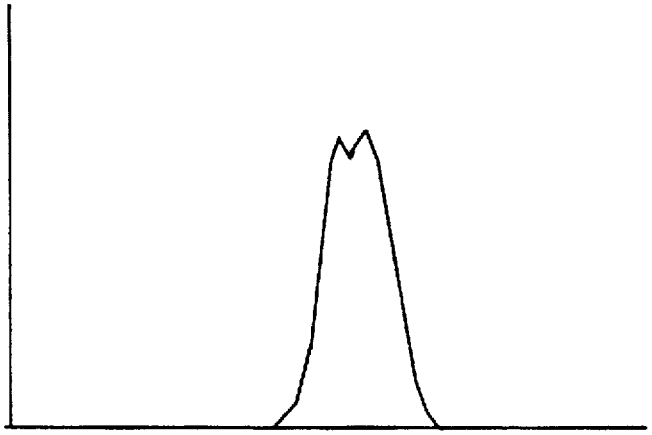
FIG. 4 is a typical shape black and white histogram extracted from a completely clear part face.

To understand the character mark algorithm it is important to understand how character marks on a part face manifests itself in $H_{BW}$. FIG. 4 shows the typical shape $H_{BW}$ extracted from a completely clear part face. As one moves from left to right, as one goes from gray level values of 0 to 255, the values of $H_{BW}$ are initially zero. A gray level value of 0 corresponds to black and a gray level value of 255 is completely white. Once the elements of $H_{BW}$ become non-zero, they rapidly increase in value until reaching a peak. Sometimes this peak is a double peak as shown in the figure. A double peak results from the difference in color between early wood and late wood on a part face. Sometimes there is only a single peak. Single peaks result from part faces that have a low frequency intensity variation across their surfaces. This low frequency variation blurs the natural double peak caused by early wood and late wood. After reaching a peak the values of $H_{BW}$ quickly go back to zero.

Figure 5:
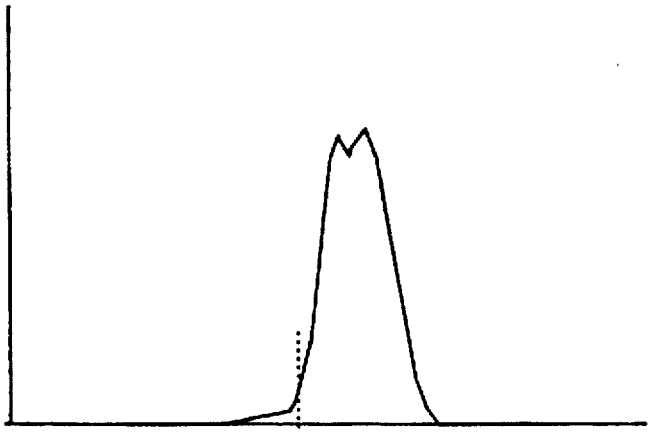
FIG. 5 is a typical shape black and white histogram extracted from a part face that has a small amount of light-colored character marks present.

FIG. 5 shows the typical shape of $H_{BW}$ extracted from a part face that has a small area of light-colored character marks present. Note the difference in this shape from that shown in FIG. 4. The shape difference can be characterized by the fact that once the elements of $H_{BW}$ become non-zero they initially do not increase in value as rapidly as is the case for completely clear parts. Note that variations in the shape of $H_{BW}$ caused by character marks will always appear on the left side of the peak because character marks are always darker than clear wood.

Figure 6:
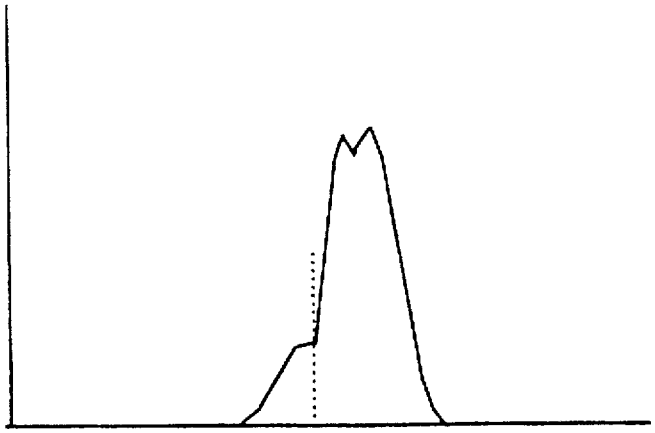
FIG. 6 is a typical shape black and white histogram extracted from a part face that has a good deal of light-colored character marks.

FIG. 6 shows yet another possibility. It shows the typical shape of $H_{BW}$ extracted from a part face that has a good deal of light-colored character marks. Statistically speaking the resulting shape is caused by the mixing of two populations each having a slightly different mean value. The key to recognizing this shape is that there is a significant inflection point that occurs on the left side of the clear wood peak.

Figure 7:
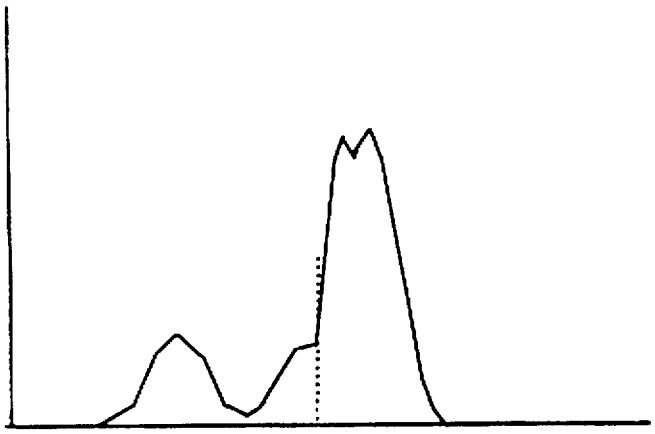
FIG. 7 is a typical shape black and white histogram extracted from a part face that has areas of very dark character mark and areas of light character marks.

FIG. 7 shows a slightly more complicated situation. It shows the typical shape of $H_{BW}$ extracted from a part face that has areas of very dark character marks and areas of light character marks. The areas of dark character marks cause the small peak shown. The highest peak must be clear wood since edge glued panel parts have the vast majority of their surface area composed of completely clear wood. The areas of light character marks in the part face once again cause the inflection point on the left side of the main peak.

Figure 8:
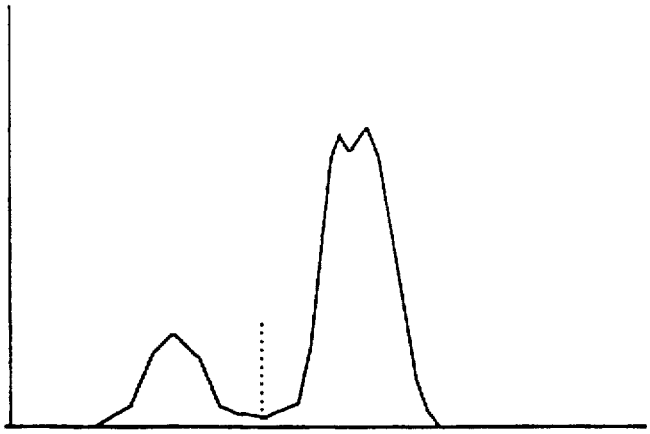
FIG. 8 is a typical shape black and white histogram extracted from a part face that has only areas of dark mineral steaks.

FIG. 8 shows the last situation that generally occurs. This shape for $H_{BW}$ results from parts that have only areas of dark character marks. No inflection points occur in this instance.

Given these possibilities the algorithm presented below is designed to find $T_{CM}$ values close to those shown in FIGS. 4–7. While the algorithm presented typically gives excellent results, it will, on occasion, make errors in selecting $T_{CM}$. Fortunately, these errors are not typically problematic since they only affect the percentage of a board's surface that is used in making the color sorts and to a lesser extent in selecting a part's "best" face.

The character mark algorithm is as follows:

1. A Gaussian filter, $n(0,\sigma^2)$, is convolved with $H_{BW}=[h_{BW}(i)]$ to smooth it. Let $H_{SBW}=[h_{SBW}(i)]$ denote the resulting smoothed histogram. The Gaussian filter is defined by an input variable, $\sigma^2$, and by the equation $$n(0,\sigma^2)=\frac{1}{\sqrt{2\pi}}\,e^{-i^2/2}$$

2. Apply a standard peak detection method to $H_{SBW}$ to locate the positions of all the peaks in $H_{SBW}$.
3. Find the highest peak, $Peak_H$, in $H_{SBW}$. Assume that this peak occurs at position $i_H$ in $H_{SBW}$, i.e. $Peak_H=h_{SBW}(i_H)$. Let $Peak_{LM}=Peak_H$ and let $i_{LM}=i_H$.
4. If there is more than one peak in $H_{SBW}$, find the next highest. Otherwise, proceed to Step 6. Label the next highest peak $Peak_{NH}$. Assume that this peak occurs at position $i_{NH}$ in $H_{SBW}$, i.e., $Peak_{NH}=h_{SBW}(i_{iNH})$.
5. If $Peak_{NH}\geqq HF\times Peak_H$ where HF is a program input variable and $0<HF<1.0$, and if $0<i_H-i_{NH}\leqq DF$ where DF is a program input variable, then let $Peak_{LM}=Peak_{Nh}$ and let $i_{LM}=i_{NH}$. This step finds which of the double peaks associated with the early wood/late wood in the clear wood cluster is the left-most peak.
6. Find the second derivative, $SD=[sd(i)]$, of $H_{SBW}$ from 0 to $i_{LM}$.
7. Let $T_{CM}=0$.
8. Starting at $i_{LM}$ 1check backwards, i.e., from $i_{LM}$ to 0, until one of two mutually exclusive situations is found to occur or not occur. That is, for $i=i_{LM}$ to 0 perform the following:
   a. A significant inflection point is located, i.e., an $i_I$ is found such that $$sd(i_I)\geqq 0,\text{ and}$$

$$sd(i_I-j_{Back})<0$$

for $j_{Back}=1,\ldots,NP_I$, and $$sd(i_I+j_{Forward})>0,$$

for $j_{Forward}=1,\ldots,NP_I$ where $NP_I$ is a program input variable. If this case occurs first let $T_{CM}=i_I$ and go to Step 10.

b. A significant valley is found in $H_{SBW}$, i.e., an $i_v$ is found such that $$h_{SBW}(i_v)\leqq h_{SBW}(i_v-j_{Back})$$

for $j_{Back}=1,\ldots,NP_v$, and $$h_{SBW}(i_v)\leqq h_{SBW}(i_v+j_{Foward})$$

for $j_{Forward}=1,\ldots,NP_v$, where $NP_v$ is a program input variable. If this case occurs first let $T_{CM}=i_v$ and go to Step 10.

9. If neither of the above cases is found then for $i=0,\ldots,i_{LM}$ do the following:
   a. Find the first derivative of $H_{SBW}$ at i. Let fd denote the first derivative at this point in $H_{SBW}(i)$.
   b. If $fd\times h_{SBW}(i)\geqq Mtest$, where Mtest is a program input variable, then let $T_{CM}=i$ and go to Step 9. Otherwise, continue.
10. Return the value of $T_{CM}$.

Steps 4 through 6 are aimed at identifying potential double peaks caused by early wood and late wood. If such peaks exist, the desire is to locate the left-most one. Once the left-most peak is located, the algorithm starts looking from the location of this peak backwards in an effort to find either a negative-to-positive (looking left to right) inflection point or a valley. The importance of inflection points was discussed above with respect to FIGS. 6 and 7. The objective is to find the first negative-to-positive inflection point as one proceeds from the left most peak to gray level 0. If such an inflection point is found first then $T_{CM}$ is set equal to the position of this inflection point, as is suggested by FIGS. 6 and 7.

On the other hand if a valley is found before a negative-to-positive inflection point, then $T_{CM}$ is set equal to the position of this valley. The motivation for doing this is presented in FIG. 8.

If none of the above is found, a multiplicative test is used. The purpose of this test is to gauge how quickly $H_{SBW}$ increases with increasing gray level. The motivation for this test comes from FIG. 5.

Figure 9:
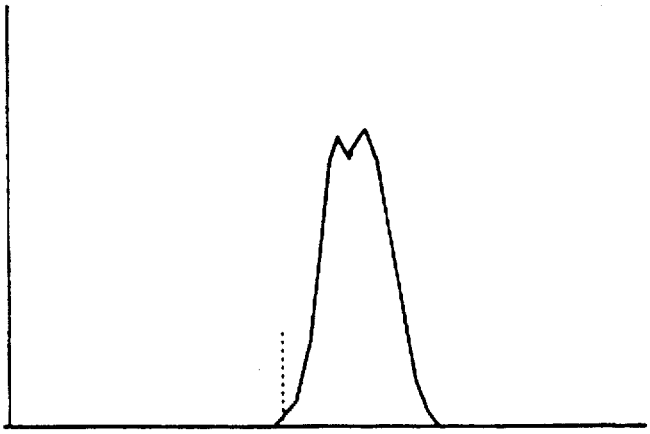
FIG. 9 is a typical shape black and white histogram extracted from a completely clear part face.
Figure 10:
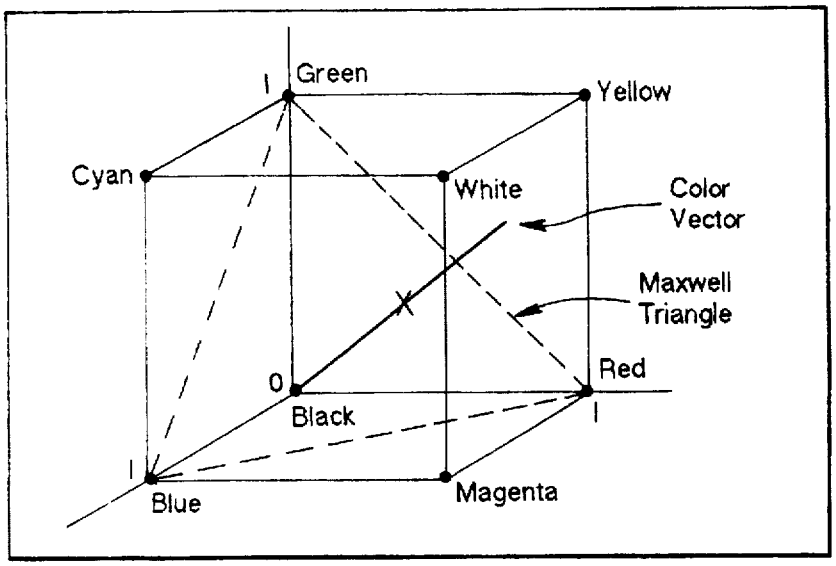
FIG. 10 is a graph illustrating the representation of a color C in three dimensional color space.
Figure 11:
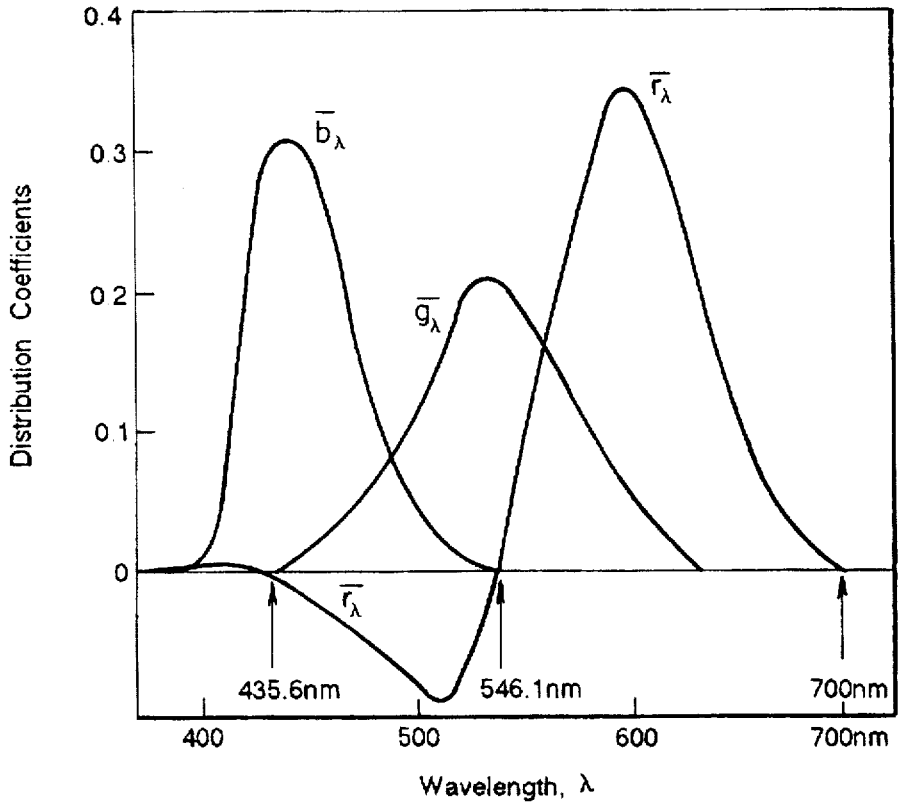
FIG. 11 illustrates the spectral distribution curves specified by the C.I.E. for its standard narrow field observer.

Finally, it should be noted that the algorithm has no way of determining that a part has a completely clear face, i.e., it will always produce a $T_{CM}\neq 0$. However, because of the nature of the multiplicative test, a $H_{SBW}$ coming from a completely clear part face will have so few elements removed as not to effect the results. FIG. 9 shows a typical threshold found for a completely clear part.

Color Mapping Algorithm

Traditional color mapping algorithms have been used to reduce the palette of colors needed to display a full color image while retaining the visual quality of the image. Examples of the use of such algorithms include mapping a full color image into 256 colors so that it can be displayed on a VGA monitor of a personal computer.

The purpose of the color mapping algorithm used in this invention is some what different. Its primary objective is to reduce the size of the measurement vector needed to represent each part face. As was stated earlier the desired measurement vector is a full color histogram, H=[h(i, j, k)], where h(i, j, k) gives the number of color pixels on a part face that have color (i, j, k). The goal of this algorithm is to reduce the dimensionality of the color measurement vector from 64×64×64=262,144 to a quantity on the order of 2000 elements.

In this very limited context of reducing the number of elements, the color mapping algorithm is very similar to the ones used to reduce the number of colors needed to give a good visual rendering of a color image. However, this algorithm has an additional very important requirement, by which it is distinguished from other color mapping algorithms. This algorithm must make removing elements in a reduced measurement vector that correspond to colors that might be areas containing character marks a computationally simple task to perform. That is, once the threshold $T_{CM}$ has been estimated from the black and white histogram $H_{BW}$, the algorithm must provide a convenient means for setting elements in a reduced measurement vector that correspond to colors whose black and white values are less than $T_{CM}$ to zero. The measurement vectors involved include the reduced measurement of a part face and the reduced measurement vectors of the color class prototypes, if the distance-from-prototype classification algorithm is employed, or the reduced measurement vectors of the individual training samples themselves, if the k-nearest neighbor pattern classification procedure is used.

The color mapping algorithm employed in this invention starts with a traditional algorithm, one conceived by Paul Heckbert, "Color Image Quantization for Frame Buffer Display," 16 *Computer Graphics*, No.3 (July 1982), pp. 297–307 ("the Heckbert article"), to which we have added features so that the additional requirement can be met.

The Heckbert Color Mapping Algorithm

In this version of the Heckbert median cut algorithm, the inputs are the matrix S=[s(i, j, k)] and the number $N_{pc}$ of possible colors. The outputs include seven matrices that define $N_{pc}$ rectangular parallelepipeds in color space, each of which represent one color in the Heckbert color mapping algorithm, as described in the Heckbert article. These matrices are MNI=[mni(l)], MNJ[mnj(l)], MNK=[mnk(l)], MXI=[mxi(l)], MXJ=[mxj(l)], MXK=[mxk(l)], and $A_{GL}$=[$a_{GL}$(l)]. For example, consider the $l^{th}$ rectangular parallelepiped, $RP_l$, found by the algorithm. Then, $$mni(l)=\min_i\{(i,j,k)\in(i,j,k)\in RP_l\},$$

$$mnj(l)=\min_j\{(i,j,k)\in(i,j,k)\in RP_l\},$$

$$mnk(l)=\min_k\{(i,j,k)\in(i,j,k)\in RP_l\},$$

$$mxi(l)=\max_i\{(i,j,k)\in(i,j,k)\in RP_l\},$$

$$mxj(l)=\max_j\{(i,j,k)\in(i,j,k)\in RP_l\},$$

and $$mxk(l)=\max_k\{(i,j,k)\in(i,j,k)\in RP_l\}.$$

From the above it should be clear that eight vertices of $RP_l$ are given by $$(mni(l),mnj(l),mnk(l)),$$

$$(mxi(l),mnj(l),mnk(l)),$$

$$(mni(l),mxj(l),mnk(l)),$$

$$(mni(l),mnj(l),mxk(l)),$$

$$(mni(l),mxj(l),mxk(l)),$$

$$(mxi(l),mnj(l),mxk(l)),$$

$$(mni(l),mxj(l),mxk(l)),$$

and, finally, $$(mxi(l),mxj(l),mxk(l)).$$

To understand $A_{GL}$ again consider the $l^{th}$ rectangular parallelepiped. Let $$T=\sum_{i=mni(l)}^{mxi(l)}\sum_{j=mnj(l)}^{mxj(l)}\sum_{k=mnk(l)}^{mxk(l)}s(i,j,k).$$

Then $$a_{GL}(l)=\frac{1}{T}\sum_{i=mni(l)}^{mxi(l)}\sum_{j=mnj(l)}^{mxj(l)}\sum_{k=mnk(l)}^{mxk(l)}\frac{(i+j+k)}{3}s(i,j,k).$$

That is, $a_{GL}$(l) is the average black and white value of the distribution of colors defined by s(i, j, k) in the $l^{th}$ rectangular parallelepiped.

A last output is the matrix $CS_{lookup}$=[$cs_{lookup}$(t)]. This lookup table provides a convenient method for translating $T_{CM}$ obtained from the black and white histogram of a part face into a position in the reduced color measurement vector. Pixels in a black and white image of a part face having gray levels between 0 and $T_{CM}$ are considered to be from areas on the part face containing character marks. The effect of these pixels on the reduced color measurement vector, CMV=[cmv(l)], must be removed so that color sorting is not affected by character marks. This is accomplished by setting cmv(l)=0 for l=0 to $cs_{lookup}(T_{CM})$.

As to the median cut algorithm, $N_{PC}$ colors defined by the rectangular parallelepipeds are used to represent an equal number of pixels occurring in the part faces of the training samples. That is, for any two rectangular parallelopipeds, for example the $l_1$ one and the $l_2$ one, $$T_{l_1} = \sum_{i=mni(l_1)}^{mxi(l_1)} \sum_{j=mnj(l_1)}^{mxj(l_1)} \sum_{k=mnk(l_1)}^{mxk(l_1)} s(i, j, k)$$

and $$T_{l_2} \sum_{i=mni(l_2)}^{mxi(l_2)} \sum_{j=mnj(l_2)}^{mxj(l_2)} \sum_{k=mnk(l_2)}^{mxk(l_2)} s(i, j, k)$$

should be such that $T_{l1}=T_{l2}$. To accomplish this, the algorithm repeatedly subdivides color space into smaller and smaller rectangular parallelepipeds. It starts by identifying the parallelepiped (box) that tightly encloses all the non-zero elements, s(i, j, k), of S. Then recursion is used to identify the final rectangular parallelepiped. The recursion is based on the following:

Iteration Step: Split Box

The box is "shrunk" to fit tightly around the non zero elements it encloses by finding the minimum and maximum coordinates for each of these elements. Next this box is partitioned. To do this the enclosed points are sorted along the longest dimension of the box and segregated into two halves at the median point. Approximately equal numbers of points will fall on each side of the cutting plane.

The above step is recursively applied until $N_{PC}$ boxes are generated. Given the nature of S=[s(i, j, k)] and the choices of $N_{PC}$ that would be used in this invention, a box containing only one point would never be generated. Hence the Split Box algorithm would never be forced to handle the situation where it is asked to split a box containing only one element.

After the $N_{PC}$ boxes are found, the matrix $A_{GL}$ is generated.

Color Mapping Used in the Invention

Given the above description of Heckbert's median color mapping algorithm the actual color mapping approach used in this invention can be given. This algorithm is as follows:

1. Apply Heckbert's median color mapping algorithm to S=[s(i, j, k)] and $N_{PC}$. The results returned are given in the matrices MNI=[i(l)], MNJ=[mnj(l)], MNK=[mnk(l)], MXI=[mxi(l)], MXJ=[mxj(l)], MXK=[mxk(l)], and $A_{GL}$=[$a_{GL}$(l)].
2. Sort the $N_{PC}$ rectangular parallelepipeds defined by MNI, MNJ, MNK, MXI, MXJ, MXK, and $A_{GL}$=[$a_{GL}$(l)] according to $a_{GL}$(l) such that if $l_1 \leqq l_2$ then $a_{GL}(l_1) \leqq a_{GL}(l_2)$. Put the results of this back into MNI=[mni(l)], MNJ=[mnj(l)], MNK=[mnk(l)], MXI=[mxi(l)], MXJ=mxj(l)], MXK=[mxk(l)], and $A_{GL}$=[$a_{GL}$(l)] such that the information about the $l^{th}$ rectangular parallelepiped is contained in mni(l), mnj(l), mnk(l), mxi(l), mxj(l), mxk(l), and $a_{GL}$(l).
3. For i=0, . . . gl+1, j=0, . . . , gl+1, and k=0, . . . , gl+1 set $$c_{lookup}(i, j, k)=gl$$

if INTEGER [(i+j+k)/3)+0.5]=gl where INTEGER is a function that converts numbers into integers without rounding.

4. Begin to setup the color mapping by letting index=0, gl=0 and l=0.
5. Let index=index+1.
6. Do the following sub-steps a and b until INTEGER [$a_{GL}$(l)+0.5]>gl or until l=$N_{PC}$
   a. For i=mni(l), . . . , mxi(l), j=mnj(l), . . . , mxj(l), and k=mnk(l), . . . , mxk(l) let $$c_{lookup}(i, j, k)=\text{index}.$$

b. Let index=index+1 and let l=l+1.
7. Let $cm_{lookup}$(gl)=index and let gl=gl+1.
8. If gl≦Mxgl and l≦$N_{pc}$ go to Step 5. Mxgl is a program input variable that specifies the number of gray levels being used. This variable has the same value as the dimension of the color space being used.

System Real-Time Color Sorting Algorithm

Just as in the case of the training algorithms, the real-time operation has two contemplated embodiments. One is based on using the distance from class prototype classifier. The other is based on using the k-nearest neighbor algorithm. The steps that are common to these two embodiments are given below:

1. Collect a color image of sample part face s. Call this color image $CI_s$. $CI_s$ is composed of three matrices, $R_s$=[$r_s$(x, y)], $G_s$=[$g_s$(x, y)], and $B_s$=[$b_s$(x, y)] that represent the red, green, and blue components respectively.
2. Shade compensate this color image to remove nonuniformities in lighting and in sensing element sensitivities across the field of view. Call the shade compensated color image $SCI_s$. $SCI_s$ is composed of three matrices, $SR_s$, $SG_s$, and $SB_s$ just as above.
3. Average the red, green, and blue components of each color pixel in $SCI_s$ to create a black and white image of part face s. Call this black and white image $BW_s$=[bw, (x, y)]. That is for all x, y let $$bw_s(x, y)=(sr_s(x, y)+sg_s(x, y)+sb_s(x, y))/3.$$

4. Apply the threshold $T_{threshold}$ to the black and white image $BW_s$ to remove background pixels from consideration. That is for all x, y let $$bw_s(x, y)=0$$

if $bw_x(x, y) \leqq T_{threshold}$.

5. Compute the reduced measurement vector $M_s$=[$m_s$(l)] using the color lookup table $C_{lookup}$=[$c_{lookup}$(i, j, k)]. That is for each (x, y) such that bw(x, y)≠0 compute $$m_s(c_{lookup}(sr_s(x, y), sg_s(x, y)))=m_s(c_{lookup}(sr_s(x, y), sg_s(x, y), sb_s(x, y)))+1$$

6. Compute the histogram, $H_{BW}$=[$h_{bw}$(i)], of the black and white image of the part face. That is for all x, y such that bw(x, y)≠0 let $$h_{BW}(bw(x, y))=h_{BW}(bw(x, y))+1.$$

7. Apply the character mark algorithm, passing $H_{BW}$ to it and getting back a value for $T_{CM}$.
8. Remove character mark pixels from the reduced measurement vector $M_s$, i.e., for l=0 to $cm_{lookup}(T_{CM})$ let $$m_s(l)=0.$$

9. Normalize the reduced measurement vector $M_s$ using the factor $$\text{Area}_{clear} = \sum_l m_s(l)$$

to form the normalized reduced measurement vector $\hat{M}_s$=[$\hat{m}_s$(l)]. That is for all l let $$\hat{m}_s(l)=m_s(l)/\text{Area}_{clear}.$$

For the first embodiment, assume that there are a total of N color classes to be considered. Then if the distance from prototype classifier is used the following steps are required:

10. Remove character mark colors from each of the prototypes so that character marks will not affect part face classification into the proper color class, i.e., for n=1 to N and for l=0 to $cm_{lookup}(T_{CM})$ let $$pr_n'(l)=0$$

and for $l>cm_{lookup}(T_{CM})$ let $$pr_n'(l)=pr_n(l).$$

11. Form a new set of modified prototypes with affects of mineral streak removed from consideration, i.e., for n=1 to N compute $$F=\sum_l pr_n'(l)$$

then for all l let $$pr_n''(l)=pr_n'/F.$$

The matrices $Pr_n''$, n=1 to N are the new prototypes.

12. Compute the distance from $\hat{M}_s$ to each of the prototypes, i.e., for n=1 to N compute $$D_n=\sum_l |pr_n''(l)-\hat{m}_s(l)|$$

13. Find n such that $D_n=\min\{D_r, r=1, \ldots, N\}$.

14. Assign a color class to part face s using the rule that if $D_n \leqq T_n$ then assign part face s to class n, otherwise assign part face to the out class.

For the second embodiment, assume, as with the first embodiment, that each color class n has a total of $m_{samples}(n)$ training samples. Then if the k-nearest neighbor classification rule is used the following steps need be performed:

10'. For n=1 to N and for m=1 to $m_{samples}(n)$ do the following:

a. Remove character mark colors from training sample $CMV_{nm}$ to create a modified measurement vector for this sample, $MMV_{nm}=[mmv_{nm}(l)]$. This is done to eliminate the effect of character mark on the color sort. That is for l=0 to $cm_{lookup}(T_{CM})$ let $$mmv_{nm}(l)=0$$

and for $l>cm_{lookup}(T_{CM})$ let $$mmv_{nm}(l)=cmv_{nm}(l).$$

b. Normalize $MMV_{nm}=[mmv_{nm}(l)]$ by letting $$F=\sum_{l>cm_{lookup}(T_{MS})} mmv_{nm}(l)$$

and for all l letting $$mmv_{nm}(l)=mmv_{nm}(l)/F$$

c. Compute the distance from $\hat{M}_s=[\hat{m}_s(l)]$ to modified training sample $MMV_{nm}=[mmv_{nm}(l)]$. That is, compute $$D_{nm}=\sum_l |mmv_{nm}(l)-\hat{m}_s(l)|.$$

11'. Find k smallest of the distance values $$\{D_{nm}, n=1, \ldots, N, m=1, \ldots, m_{samples}(n)\}.$$

12'. Find the color class label that occurs the most often in the training vectors with the k smallest distances. Call this class label $color_{label}$.

13'. Assign part face s to color class $color_{label}$ if the shortest distance between $\hat{M}_s=[\hat{m}_s(l)]$ and the training samples of $color_{label}$ in the set of the k-nearest neighbors is less than the threshold, $T_{color_{label}}$. Call this minimal distance $D_{color_{label}}$. This is the distance value that is passed to the best face algorithm.

Regardless of which of the color classification algorithms are used, the computer process one part face at a time with the same steps being applied to each face.

Some capabilities of the real-time system should be noted. First, at the time of startup the real-time system loads parameters needed to do the classification from a disk file. This file is created by the training algorithm. The files to be loaded are user defined. Hence to process red oak an operator must type in the file names of the red oak training files. If, later, the desire is to change from red oak to hard maple, the operates halts red oak real-time processing. Then he restarts the real-time system this time typing in the file names of hard maple files.

To change the uniformity of a sort, the operator at startup can change the $T_n$, n=1, . . . , N, values. The smaller these values are made the more uniform the sort. The larger, the less uniform with part faces having greater color differences being placed in the same color class. Obviously, since the $T_n$, n=1, . . . , N, values also control the number of parts sorted into the out class, as a $T_n$ is made larger the number of parts going into the out class decreases. As a $T_n$ is made smaller, the number of parts going into the out class increases. Hence, to mitigate the number of out class parts that have to be handled manually, additional classes may have to be added in order to span the set of colors that occur in a hardwood species parts.

Lastly, as will be noted in Steps 12 and 10' Part c, the $l_p$ norm or metric used in this embodiment is $l_1$. This norm was chosen because it seemingly provided reasonably accurate results while, at the same time, being very easy to compute. As a greater understanding of this technology is developed a different $l_p$ norm may be found that gives better sorting accuracies.

Real-Time Best Face Algorithm

The real-time classification algorithms pass three pieces of information about each part face to the best face selection algorithm. These are (1) the class label of the color class to which the face has been assigned; (2) a distance measure; and (3) $Area_{clear}$, the clear area of the part face. If the distance from prototype algorithm is used the distance passed is $D_n$, the distance defined in Step 14 of the first embodiment of the real-time color sorting algorithm. If the k-nearest neighbor algorithm is used, the distance passed is $D_{color_{label}}$, defined in Step 13' in of the second embodiment of the real-time color sorting algorithm.

For purposes of this discussion, $label_1$ is the color class label assigned to face 1 of the part, $D_1$ is the distance measure passed for this face, and $Area_1$ is the clear area of this part face. Similarity $label_2$ is the color class label assigned to face 2 of the part, $D_2$ is the distance measure passed for this face, and $Area_2$ is the clear area of the second part face.

The following steps define the best face algorithm in accordance with the present invention:

1. If $label_1$=$label_2$=out assign no best face and sort the part into the out class.
2. If either one of $label_1$ or $label_2$ is equal to out, assign the best face to the face whose label is not out and sort the part into this class.
3. If $1-T_{area}>Area_1/Area_2$ then assign the best face to face 2 and sort the part into color class $label_2$. This step assigns the best face to the side which has significantly less character mark than the other face. Note, $T_{Area}$ is a program input variable.
4. If $1+T_{area}>Area_1/Area_2$ then assign the best face to face 1 and sort the part into color class $label_1$. Again the object is to assign the best face to the side which has significantly less character mark than the other face.
5. If $label_1$ has a higher priority than $label_2$ then assign the best face to face 1 and sort the part into color class $label_1$. As will be appreciated by those of skill in the art, the priority of each class is a program input parameter.
6. If $label_2$ has a higher priority than $label_1$, then assign the best face to face 2 and sort the part into color class $label_2$.
7. If color classes $label_1$ and $label_2$ both have the same priority and $D_1 \leqq D_2$ assign the best face to face 1 and sort the part into color class $label_1$
8. If color classes $label_1$ and $label_2$ both have the same priority and $D_2<D_1$ assign the best face to face 2 and sort the part into color class $label_2$.

As was noted previously, a robust color sorting system must provide the capability for management to easily change the relative priorities of the various color classes to meet the ever-changing needs of the manufacturing process. This invention attempts to do just that. The priorities of the various color classes are stored in a disk file. At the time that real-time operation is begun these parameters are read from disk and stored in computer memory. Hence, to change the priorities of the classes, an operator need only halt real-time operation, and access a utility program that can alter the priorities of the color classes as they are defined in the disk file. Once the modifications have been saved to the file, the operator only need start real-time operation again.

System Grain Sorting Training Algorithm

Training for grain matching is done independently of the training that is done for color sorting. The grain matching operation requires only black and white imagery. Since, for color matching, color images are collected, one of the first operations is to convert a color image of a face into a black and white image of the face. As will be described hereinafter, the grain matching training procedure shares a number of common steps with the training used for color matching.

Suppose $N_g$ grain classes have been selected for the sort. Let the matrix $M_g=[m_g(n)]$ give the number of training samples available in each of the $N_g$ grain classes. As before, a training sample is one face of an edge-glued panel part. This face represents what is considered to be a prototypical example of the grain class to which the face has been assigned. To perform system training the selected parts are all run through the system with their selected faces up.

The training algorithm is as follows:

1. For $n=1, \ldots, N_g$ and $m=1, \ldots, m_g(n)$ do the following:
   a. Collect the color image, $CI_{nm}$, of the $m^{th}$ training sample of class n. $CI_{nm}$ is composed of three matrices, $R_{nm}=[r_{nm}(x, y)]$, $G_{nm}=[g_{nm}(x, y)]$, and $B_{nm}(x, y)]$ that represent the red, green, and blue components respectively.
   b. Apply the shading compensation algorithm described previously to $CI_{nm}$ to remove nonuniformities in lighting and in camera sensing element sensitivities across the field of view, to calculate the shading compensated color image $SCI_{nm}$. As above $SCI_{nm}$ is composed of three matrices, $SR_{nm}=[sr_{nm}(x, y)]$, $SG_{nm}=[sg_{nm}(x, y)]$, and $SB_{nm}=[sb_{nm}(x, y)]$.
   c. Using $SCI_{nm}$ average the red, green, and blue channel values to form a black and white image, $BW_{nm}=[bw_{nm}(x,y)]$, i.e., for all x and y let $$bw_{nm}(x, y)=(sr_{nm}(x, y)+sg_{nm}(x, y)=sb_{nm}(x, y))/3.$$

d. Apply a preselected threshold, $T_{background}$, to the black and white image $BW_{nm}$ so that background pixels can be removed from further consideration, i.e., for all x and y such that $bw_{nm}(x, y) \leqq T_{thresholdd}$ let $$bw_{nm}(x, y)=0.$$

e. Using $BW_{nm}$ compute the black/white histogram $H_{BW}=[h_{BW}(i)]$ for this part face, ignoring any background pixels. That is, for all x and y such that $bw(x, y) \neq 0$ let $$h_{BW}(bw(x, y))=h_{BW}(bw(x, y))+1.$$

f. Apply the character mark algorithm to the black/white histogram, $H_{BW}$, to find the threshold $T_{CM}$.
   g. Remove character mark pixels from the black and white histogram $H_{BW}$, i.e., for $0 \leqq i \leqq T_{CM}$ let $$h_{BW}(i)=0.$$

h. Remove character mark areas from further consideration by labeling them as background pixels in $BW_{nm}$, i.e., for all x and y such that $bw(x, y) \leqq T_{CM}$ let $$bw(x, y)=0.$$

i. Compute $$F_{total}=\sum_i h_{BW}(i).$$

j. Apply the equal probability quantizing (EPQ) algorithm previously described to the black and white image, $BW_{nm}$, of the part, the histogram, $H_{BW}=[h_{BW}(i)]$, of the black and white image, the normalizing factor, $F_{total}$, and NGL, the number of gray levels to appear in the requantized black and white image. The algorithm returns a requantized version of $BW_{nm}$. In this requantized $BW_{nm}$, $bw(x, y)=0$ still indicates background pixels, and for x and y that are not background pixels $1<bw(x, y) \leqq NGL$.
   k. Apply an edge detector that is most sensitive to vertical edges to $BW_{nm}$. This application should not generate any edge points between background (character mark) and part face. The result is the gradient image, $G_v=[gv(x, y)]$. $G_v$, records the absolute value of the output of the edge detector.
   l. Apply an edge detector which is most sensitive to horizontal edges to $BW_{nm}$. This application should not generate any edge points between background (character mark) and part face. The result is the gradient image, $G_H=[g_H(x, y)]$. $G_H$ records the absolute value of the output of the edge detector.

m. Apply an edge detector that is most sensitive to right diagonal edges to $BW_{nm}$. This application should not generate any edge points between background (character mark) and part face. The result is the gradient image, $G_{RD}=[g_{RD}(x, y)]$. $G_{RD}$, records the absolute value of the output of the edge detector.

n. Apply an edge detector which is most sensitive to left diagonal edges to $BW_{nm}$. This application should not generate any edge points between background (character mark) and part face. The result is the gradient image, $G_{LD}=[g_{LD}(x, y)]$. $G_{LD}$, records the absolute value of the output of the edge detector.

o. Average $G_{RD}$ and $G_{LD}$ to find a single gradient image, $G_D=[g_D(x, y)]$, that indicates the number of diagonal edges present in either the right or left diagonal directions, i.e., for all x and y let $$g_D(x, y)=\text{INTEGER}\ [(g_{RD}(x, y)+g_{LD}(x, y))/2+0.5]$$

where the INTEGER function is as described previously.

p. Create the edge histogram $EG_{nm}=[eg_{nm}(\Delta i, \Delta j, \Delta k)]$ where $eg_{nm}(\Delta i, \Delta j, \Delta k)$ is the total number of points, (x, y), in images $G_V$, $G_H$, and $G_D$, such that $g_V(x, y)=\Delta i$, $g_H(x, y)=\Delta j$, and $g_D(x, y)=\Delta k$. That is for all x and y let $$eg_{nm}(g_V(x, y), g_H(x, y), g_D(x, y)))=eg_{nm}(g_V(x, y), g_D(x, y), g_D(x, y))+1.$$

q. Normalize $EG_{nm}$ so that $$\sum_{\Delta i}\sum_{\Delta j}\sum_{\Delta k} eg_{nm}(\Delta i, \Delta j, \Delta k) = 1.0.$$

This is accomplished by letting $$F = \sum_{\Delta i}\sum_{\Delta j}\sum_{\Delta k} eg_{nm}(\Delta i, \Delta j, \Delta k)$$

and then for all Δi, Δj, and Δk, letting $$eg_{nm}(\Delta i, \Delta j, \Delta k)=eg_{nm}(\Delta i, \Delta j, \Delta k)/F.$$

It is noted that in an actual implementation, the steps stated above would not necessarily be performed in the exact order that they appear here. By combining certain operations together computational efficiencies can be achieved. It is believed that the above steps represent the simplest conceptualization for describing the processing.

In addition to the above steps other steps must be performed as well. However, these remaining steps depend on which embodiment of the device is being used. Two different embodiments are possible. They differ depending on the methods used for making the decision as to which color class a particular part face belongs. In a first embodiment of the grain sorting training algorithm, a single prototype is used to represent each class. In this embodiment a part face is assigned to a class based on the distance its grain pattern measurement vector is from the various class prototypes. The prototype that produces the minimum distance is the class to which the part face is assigned given that this distance is less than some specified threshold. Using these thresholds provides the capability of having an out class. A part face is assigned to the out class if it lies too far away from of the prototype of the class to which it has been assigned. This distance from class prototype grain sorting method is useful if the parts in each class have a very uniform grain direction.

The steps involved in the first embodiment are as follows:

2. Find the class prototype, $Pr_n=[pr_n(\Delta i, \Delta j, \Delta k)]$ for each class n. That is, for n=1 to $N_g$ do the following:

a. For all Δi, Δj, and Δk let $$pr_n(\Delta i, \Delta j, \Delta k) = \sum_{m=1}^{m_g(n)} eg_{nm}(\Delta i, \Delta j, \Delta k).$$

b. Next compute $$F = \sum_{\Delta i}\sum_{\Delta j}\sum_{\Delta k} pr_n(\Delta i, \Delta j, \Delta k).$$

c. Then for all Δi, Δj, and Δk let $$pr_n(\Delta i, \Delta j, \Delta k)=pr_n(\Delta i, \Delta j, \Delta k)/F.$$

The resulting $Pr_n=[pr_n(\Delta i, \Delta j, \Delta k)]$ is the prototype for class n.

3. For each class n, n=1, . . . $N_g$, estimate the threshold $T_{gn}$ by examining all the training samples, $EG_{nm}$, for all the classes and selecting $T_{gn}$ that gives the minimum probability of error.

A second embodiment of the grain sorting training algorithm in accordance with the present invention uses the k-nearest neighbor classification procedure, as described by Duda and Hart. This pattern classification method is useful if one or more of the grain pattern classes is made up of parts that have a variety of different grain patterns. Note that this method for grain sorting parts is much more computationally complex than the method described above and hence should only be used when one or more of the grain classes contain parts that have a variety of different grain patterns. To use this classification method the measurement vector from each sample in each grain class must be saved in computer memory. The measurement vector used to characterize the grain pattern of a part face is computed. The distance from this measurement vector to each of the measurement vectors computed from each of the training samples is determined. The k measurement vectors of the training samples that are the closest to the one computed from the part face are then found. The part face is assigned the class to which the most of the k-nearest training sample measurement vectors belong. To provide for an out class the distance between the part face's measurement vector and the closest training sample in the class to which the part face has been assigned is compared to a threshold value. If this distance is less than or equal to the threshold value the part face's classification remains unchanged. If, however, this distance is greater than the threshold value, the part face's classification is changed to the out class. The step needed to implement this second embodiment of the training algorithm is as follows:

2'. For each class, n, n=1, . . . , $N_g$ estimate the threshold $T_{gn}$ by examining all the training samples, $EG_{nm}$, for all the classes and selecting $T_{gn}$ that gives the best results.

Just as is the case with the color sorting training algorithm, the results of the grain sorting training algorithm are stored in disk files that are read by the systems real-time grain sorting algorithm when it is started up. In this way training files for a number of different species can be created and stored on disk. This allows the system to handle a variety of different species. The appropriate training files for the species to be processed only need be loaded into the real-time algorithm at the time it is started up.

Finally, the quantities $T_{gn}$ defined in either Step 3 or in Step 2', depending on the classification method being used, are only approximations to the actual values for these thresholds. This follows from the fact that under typical training conditions only a very limited number of training samples are used. Plant personnel can change these values after the training is performed. These parameters provide the mechanism for plant personnel to change the uniformity of the sort. If a $T_{gn}$ is made smaller then all the parts sorted into a grain class in will have approximately the same grain pattern. If $T_{gn}$ is made larger then parts with more diverse grain patterns will be sorted into a grain class. Having a separate parameter for each grain class allows optimal control of the sorting process.

System real-time grain sorting algorithms

These real-time algorithms are performed after both part faces have been color sorted and after the best face of the part has been selected. Hence, it is assumed that the black and white image, BW=[bw(x, y)], of the best face of the part, the histogram, $H_{BW}=[h_{BW}(i)]$, of this face, and the character mark threshold, $T_{CM}$, for this face are all available. Note all these items are computed during the real-time color sorting operation. It is further assumed that all background pixels in BW have been removed from further consideration by having each such pixel being set equal to zero. This operation is also performed during the real-time color sorting operation.

Just as in the case of the training and real-time grain sorting algorithms, the real-time operation has two embodiments. One is based on using the distance from class prototype classifier. The other is based on using the k-nearest neighbor algorithm. The steps that are common to these two embodiments are given below:

1. Remove character mark pixels from the black and white histogram, $H_{BW}=[h_{BW}(i)]$ of the best part face, i.e., for $0 \leqq i \leqq T_{CM}$ let $$h_{BW}(i)=0.$$

2. Remove mineral streak areas from further consideration by labeling them as background pixels in BW, the black and white image of the best part face, i.e., for all x and y such that $bw(x, y) \leqq T_{CM}$ let $$bw(x, y)=0.$$

3. Compute $$F_{total} = \sum_i h_{BW}(i).$$

4. Apply the equal probability quantizing (EPQ) algorithm, passing it the black and white image of the best part face, BW, the histogram, $H_{BW}=[h_{BW}(i)]$, of this image, the normalizing factor, $F_{total}$, and NGL, the number of gray levels to appear in the requantized black and white image. The algorithm returns a requantized version of BW. In this requantized BW, bw(x, y)=0 still indicates background pixels and for x and y that are not background pixels $1 \leqq bw(x, y) \leqq NGL$.
5. Apply an edge detector that is most sensitive to vertical edges to BW. This application should not generate any edge points between background (character mark) and part face. The result is the gradient image, $G_V=[g_V(x, y)]$. This image records the absolute value of the edge points found.
6. Apply an edge detector that is most sensitive to horizontal edges to BW. This application should not generate any edge points between background (character mark) and part face. The result is the gradient image, $G_H=[g_H(x, y)]$. This image records the absolute value of the edge points found.
7. Apply an edge detector that is most sensitive to right diagonal edges to BW. This application should not generate any edge points between background (character mark) and part face. The result is the gradient image, $G_{RD}=[g_{RD}(x, y)]$. This image records the absolute value of the edge points found.
8. Apply an edge detector that is most sensitive to left diagonal edges to BW. This application should not generate any edge points between background (character mark) and part face. The result is the gradient image, $G_{LD}=[g_{LD}(x, y)]$. This image records the absolute value of the edge points found.
9. Average $G_{RD}$ and $G_{LD}$ to form a single gradient image, $G_D=[g_D(x, y)]$, that indicates the number of diagonal edges present in either the right or left diagonal directions, i.e., for all x and y let $$g_D(x, y)=\text{INTEGER}\ [(g_{RD}(x, y)+g_{LD}(x, y))/2+0.5]$$

where the INTEGER function is as described previously.

10. Create the edge histogram, EG=[eg(Δi, Δj, Δk)] where eg(Δi, Δj, Δk) is the total number of points, (x, y), in images $G_V$, $G_H$, and $G_D$, such that $g_V(x, y)=\Delta i$, $g_H(x, y)=\Delta j$, and $g_D(x, y)=\Delta k$. That is for all x and y let $$eg(g_V(x, y), g_H(x, y), g_D(x, y))=eg(g_V(x, y), g_H(x, y), g_D(x, y))+1.$$

11. Normalize EG so that $$\sum_{\Delta i}\sum_{\Delta j}\sum_{\Delta k} eg(\Delta i, \Delta j, \Delta k) = 1.0.$$

This is accomplished by letting $$F = \sum_{\Delta i}\sum_{\Delta j}\sum_{\Delta k} eg(\Delta i, \Delta j, \Delta k)$$

and then for all Δi, Δj, and Δk, letting $$eg(\Delta i, \Delta j, \Delta k)=eg(\Delta i, \Delta j, \Delta k)/F.$$

Assume that there are a total of $N_g$ color classes to be considered. Then if the distance from prototype classifier is used the following steps are required:

12. Compute the distance EG is from each of the prototypes, i.e., for n=1 to $N_g$ compute $$D_n = \sum_{\Delta i}\sum_{\Delta j}\sum_{\Delta k} |pr_n(\Delta i, \Delta j, \Delta k) - eg(\Delta i, \Delta j, \Delta k)|.$$

13. Find n such that $D_n=\min\{D_r, r=1, \ldots, N_g\}$.
14. Assign a grain pattern class to part face s using the rule that if $D_n \leqq T_{gn}$ then assign part face s to class n, otherwise assign part face to the out class.

Assume, as has been done previously, that each color class n has a total of $m_g(n)$ training samples. Then if the k-nearest neighbor classification rule is used the following steps need be performed:

12'. Compute how far EG is from each of the training samples, $EG_{nm}$. That is, for n=1 to N and for m=1 to $m_g(n)$ compute $$D_{nm} = \sum_{\Delta i} \sum_{\Delta j} \sum_{\Delta k} |eg_{nm}(\Delta i, \Delta j, \Delta k) - eg(\Delta i, \Delta j, \Delta k)|.$$

13'. Find the k smallest of the distance values $$\{D_{nm}, n=1, \ldots, N_g, m=1, \ldots, m_g(n)\}$$

14'. Find the grain class label that occurs the most often in the training vectors with the k smallest distances. Call this class label $grain_{label}$.

15'. Assign part face s to grain class $grain_{label}$ if the shortest distance between EG=[eg(Δi, Δj, Δk)] and the training samples of $grain_{label}$ in the set of the k-nearest neighbors is less than the threshold, $T_{grain_{label}}$.

Some capabilities of the real-time system should be noted. First, at the time of startup the real-time system loads parameters needed to do the classification from a disk file. This file is created by the grain sorting training algorithm. The files to be loaded are user defined. Hence to process red oak an operator must input the file names of the red oak training files. If, later, the desire is to change from red oak to hard maple, the halts red oak real-time processing. Then he restarts the real-time system this time typing in the file names of hard maple files.

To change the uniformity of a sort, the operator at startup can change the $T_{gn}$, n=1, . . . , $N_g$, values. The smaller these values are made, the more uniform the sort. The larger these values are made the less uniform the sort, with part faces with greater grain differences being placed in the same grain class. Obviously, since the $T_{gn}$, n=1, . . . , $N_g$, values also control the number of parts sorted into the out class, as a $T_{gn}$ is made larger the number of parts going into the out class decreases. As a $T_{gn}$ is made smaller the number of parts going into the out class increases. Hence, to mitigate the number of out class parts that have to be handled manually, additional classes may have to be added in order to span the set of grain patterns that occur in a hardwood species' parts.

Lastly, as will be noted in Steps 12 and 12', the $l_p$ norm or metric used in this embodiment is $l_1$. This norm was chosen because it seemingly provides reasonably accurate results while, at the same time, being very easy to compute. As a greater understanding of this technology is developed a different $l_p$ norm may be found that gives better sorting accuracies.

Algorithm for Normalizing Variations in Sensitivity Between Cameras

As was discussed above, two color cameras can have varying sensitivities. Because, for purposes of this invention, two color cameras 20*a* and 20*b* must be used and because based on the data from each a "best" face must be selected, it is important that the top and bottom cameras be equally sensitive to each color. To ensure this will be the case, we have created a normalizing algorithm that effectively maps the output of one camera into the output of a second, so that the response of both cameras is the same for each possible color.

As with the shading correction algorithm, this normalizing algorithm requires that data be collected prior to employing it in real-time data collection, whether that data collection be for purposes of training or for real-time sorting. After the cameras 20*a* and 20*b* have been pointed, the lights 12*a* and 12*b* (or 16) adjusted, and the automatic light adjustment program is running, the required data can be collected. It is further assumed that the shading correction algorithm has been set up and is capable of correcting imagery from both color cameras 20*a* and 20*b*. Note each camera 20*a* and 20*b* will need its own set of calibration data.

To use the normalizing algorithm, approximately ten to fifteen color samples are required. Let $N_{color}$ be the number of color samples to be used. These color samples must span the intensity levels that the cameras 20*a* and 20*b* have been setup to handle. In fact, each "color" could be a different shade of gray. Each color sample must be presented to each camera in the same plane as a part face would be presented. The data collection part of the algorithm is as follows:

1. For n=1, . . . , $N_{color}$ perform the following steps:
   a. Scan color sample n to collect a color image of this sample from each camera. Let $CI_1$ denote the color image collected from camera 20*a* and let $CI_2$ denote the color image of this sample collected from-n camera 20*b*. Each color image is made up of three component images. Let $R_1=[r_1(x, y)]$, $G_1=[g_1(x, y)]$, and $B_1=[b_1(x, y)]$ be the component images of $CI_1$ and let $R_2=[r_2(x, y)]$, $G_2=[g_2(x y)]$, and $B_2=[b_2(x, ),)]$ be the component images of $CI_2$.
   b. Apply the shading correction algorithm to both these color images. Each of cameras 20*a* and 20*b* will have its own set of data that is used to define the shading correction transformation. Let $SCI_1$ and $SCI_2$ denote the resulting shading corrected images. Further let $SR_1=[sr_1(x, y)]$, $SG_1=[sg_1(x, y)]$, and $SB_1=[sb_1(x, y)]$ be the component images of $SCI_1$ and let $SR_2=[sr_2(x, y)]$, $SG_2=[sg_2(x, y)]$, and $SB_2=[sb_2(x, y)]$ be the component images of $SCI_2$.
   c. Assume both color images contain the same number of pixels. Let F denote this number.
   d. Compute the values of the matrices $AVG_{R1}$, $AVG_{G1}$, $AVG_{B1}$, $AVG_{R2}$, $AVG_{G2}$, and $AVG_{B2}$ using the equations $$avg_{R1}(n) = \frac{1}{F} \sum_x \sum_y sr_1(x,y).$$

$$avg_{G1}(n) = \frac{1}{F} \sum_x \sum_y sg_1(x,y).$$

$$avg_{B1}(n) = \frac{1}{F} \sum_x \sum_y sb_1(x,y).$$

$$avg_{R2}(n) = \frac{1}{F} \sum_x \sum_y sr_2(x,y).$$

$$avg_{G2}(n) = \frac{1}{F} \sum_x \sum_y sg_2(x,y).$$

$$avg_{B2}(n) = \frac{1}{F} \sum_x \sum_y sb_2(x,y).$$

where by convention $AVG_{R1}=[avg_{R1}(n)]$, $AVG_{G1}=[avg_{G1}(n)]$, $AVG_{B1}=[avg_{B1}(n)]$, $AVG_{R2}=[avg_{B2}(n)]$, $AVG_{G2}=[avg_{G2}(n)]$, and $AVG_{B2}=[avg_{B2}(n)]$.

2. Create a two-dimensional plot of the relative red responses of the two cameras 20*a* and 20*b* to the $N_{color}$ color targets. The horizontal axis ranges from 0 to 255. It represents the output gray level value for the red channel of camera 20*a*. The vertical axis also ranges from 0 to 255 and is the output gray level value for the red channel of camera 20*b*. $N_{color}$ points are plotted on this graph. These are ($avg_{R1}(n)$, $avg_{R2}(n)$), n=1, . . . , $N_{color}$.
3. Create a two-dimensional plot of the relative green responses of the two cameras to the $N_{color}$ color targets. The horizontal axis ranges from 0 to 255. It represents the output gray level value for the green channel of camera 20*a*. The vertical axis also ranges from 0 to 255 and is the output gray level value for the green channel of camera 20*b*. $N_{color}$ points are plotted on this graph. These are ($avg_{G1}(n)$, $avg_{G2}(n)$), n=1, . . . , $N_{color}$.

4. Create a two-dimensional plot of the relative blue responses of the two cameras 20a and 20b to the $N_{color}$ color targets. The horizontal axis ranges from 0 to 255. It represents the output gray level value for the blue channel of camera 20a. The vertical axis also ranges from 0 to 255 and is the output gray level value for the red channel of camera 20b. $N_{color}$ points are plotted on this graph. These are $(avg_{B1}(n), avg_{B2}(n))$, n=1, . . . , $N_{color}$.
5. Determine if the function y=x is the function that best fits the points on all three of the plots. This is done by inspection. If this is the case, terminate execution of this algorithm since no adjustment in either camera output is needed.
6. Otherwise, estimate the degree of polynomial function that would seemingly best fit the relative response data.
7. Use a least squares fitting program to define a function for each graph that fits the data. Suppose y=f(x) is one of the functions found, where x is the output gray level for a channel of data from camera 20a and y is the output gray level for the same channel of data from camera 20b.
5. Create three lookup tables that map the output of camera 20a into the output of camera 20b. Consider for example y=f(x) mentioned above. The lookup table $CH_{lookup}=[ch_{lookup}(i)]$ for the channel from which this function was estimated would be found by letting $$ch_{lookup}(i)=\text{INTEGER}\ (f(i)+0.5)$$

for=1, . . . , 255 where INTEGER is a function as described previously.

If the lookup tables are needed because of variations in camera response, then these lookup tables are employed at the end of the shading correction algorithm to perform the necessary mapping. For example, after $R_{corrected}=[r_{corrected}(i)]$ has been found, the red channel lookup table, $RED_{lookup}=[red_{lookup}(i)]$ found using the methods described above would be employed. That is the final corrected red response of the red channel, $R_{final}=[r_{final}(i)]$ is found by letting $$red_{final}(i)=red_{lookup}(r_{corrected}(i)).$$

The final corrected green and blue response is found in a similar manner.

Modifications and variations of the above-described embodiments of the present invention are possible, as will be appreciated by those skilled in the art in light of the above teachings. Most importantly, this invention is not limited to the color sorting and grain sorting wooden parts. It has a broader range of applicability. In fact, the range of problems that this device can address can be precisely defined mathematically. First, with regard to color sorting, this device is applicable to any problem where there is some fluctuation of an item's color across its surface and where each member of a color class that is to be sorted is such that all members of the class share some common colors.

More precisely, suppose that a problem domain requires items to be sorted into M color classes, say $C_1, C_2, \ldots, C_M$. This invention is applicable to this problem domain if for each $C_m$, m=1, . . . , M, any two members $member_1$ and $member_2$ of $C_m$ are such that the three-dimensional color histograms of the surface colors of $member_1$ and $member_2$ always share common non-zero elements. That is, if $H_1=[h_1(i, j, k)]$ is the three-dimensional color histogram of the surface color of $member_1$ and $H_2=[h_2(i, j, k)]$ is the three-dimensional color histogram of the surface color of $member_2$ there exists at least one color, (i, j, k), such that $h_1(i, j, k)\neq 0$ and $h_2(i, j, k)\neq 0$. Further, as a general rule, the more colors (i, j, k) for which the histograms share non-zero elements the better the algorithm will work.

The basis for this color sorting methodology comes from the conjunction of two theses. The first thesis is that the best way to represent the color variation across an item's surface is the three-dimension color histogram, H=[h(i, j, k)] of the item's surface color, or more precisely, the estimated probability function P=[p(i, j, k)] where $$p(i, j, k)=h(i, j, k)/F$$

and where $$F=\sum_i \sum_j \sum_k h(i,j,k).$$

The second thesis is that the perceived similarity of two items' surface color can be gauged by a $l_p$ norm applied to the above-described estimated probability functions. That is, if the estimated probability function of item 1's surface color is $P_1=[p_1(i, j, k)]$ and if the estimated probability function of item 2's surface color is $P_2=[p_2(i, j, k)]$, then a measure of the perceived color similarity of the two items is of the form $$\|P_1-P_2\|=\left(\sum_i \sum_j \sum_k |p_1(i,j,k)-p_2(i,j,k)|^p\right)^{1/p}.$$

The present invention goes to some length to reduce the dimensionality of the analysis problem by applying color mapping techniques to P=[p(i, j, k)]. However, this is done only to allow the color sorting operation to be performed in real-time on today's personal computers. As computers become faster and memory becomes less expensive using P=[p(i, j, k)] may become more attractive and allow better sorting to be done. Further this invention uses the $l_1$ norm as the metric for color similarity. This particular $l_p$ norm was selected because of its computational simplicity. As experience is gained in the art, other $l_p$ norms may be found to be appropriate. Indeed, the choice of the norm to use may be problem dependent. Again as computers become faster, the choice of the appropriate norm will not have to be predicted on computational simplicity.

In the present invention, the Heckbert algorithm is the color mapping algorithm employed to reduce the dimensionality of the measurement vector used to characterize an item's surface color. It was selected because of its computational simplicity and because this color mapping method is considered to be a very robust one by persons knowledgeable of the art. However, other color mapping methods have been developed and, indeed, it is possible that the selection of which algorithm to use may be application problem depend.

Finally, neural networks may offer an attractive alternative to the pattern recognition methods currently being employed. The best implementation using neural networks would appear to be one where either P=[p(i, j, k)] or a reduced measurement vector resulting from the application of a color mapping algorithm is input into the network. The nonlinearity and the adaptability of the network seemingly offers an attractive way to better match human judgments of color similarity.

With regard to the grain sorting operation it, too, has applicability to other problem domains. Grain sorting is not limited to wood products; grain sorting is nothing more that sorting parts based on surface texture. The methods developed can be applied to other surface texture sorting problems. As with the color sorting operation, the domain of applicability for the texture sorting methods can be precisely defined mathematically.

Suppose that a problem domain requires items to be sorted into M surface texture classes, say $T_1, T_2, \ldots, T_M$. The present invention is applicable to this problem domain if for each $T_m$, m=1, . . . , M, any two members $member_1$ and $member_2$ of $C_m$ are such that the three-dimensional edge histograms of the surface textures of $member_1$ and $member_2$ always share common non-zero elements. That is if $EG_1=[eg_1(\Delta i, \Delta j, \Delta k)]$ is the three-dimensional edge histogram of the surface texture of $member_1$ and $EG_2=[eg_2(\Delta i, \Delta j, \Delta k)]$ is the three-dimensional edge histogram of the surface texture of $member_2$ there exists at least one element $(\Delta i, \Delta j, \Delta k)$, such that $eg_1(\Delta i, \Delta j, \Delta k)\neq 0$ and $eg_2(\Delta i, \Delta j, \Delta k)\neq 0$. Further, as a general rule, the more elements for which the histograms share non-zero elements, the better the texture sorting algorithm will work.

The grain sorting problem does not require differentiation between right-diagonal edges and left-diagonal edges. Hence, $G_{RD}=[g_{RD}(x, y)]$ and $G_{LD}=[g_{LD}(x, y)]$ were averaged together in the above-described algorithms to form $G_D=[g_D(x, y)]$. As a result $EG=[eg(\Delta i, \Delta j, \Delta k)]$ is three-dimensional. However, some problems may require that right-diagonal edges be differentiated from left-diagonal edges. In such cases $G_{RD}$ and $G_{LD}$ should not be averaged. Therefore EG becomes four-dimensional. The rest of the analysis proceeds from the above-described analysis in a straightforward manner which will be understood by those of skill in the art.

Also, even though EG is not a color histogram, the Heckbert algorithm or some other color mapping algorithm can be applied to it to reduce the dimensionality of the measurement vector needed to do texture sorting. In the case of the Heckbert algorithm, this is true even when EG is four-dimensional. It is also true for a number of other color mapping algorithms. Because of the similarities between the texture sorting and color sorting operations, incorporating this step into the texture sorting process can be done in a straightforward manner to those skilled in the art. One of skill in the art need only examine the color sorting algorithm to see how it should be done.

As to the "best" face algorithm, it will vary with the application problem to be considered. For example, in the sorting, of wooden parts, there are applications where grain is very important. For such applications, knowing the grain class of a face becomes important in determining which part face is the "best" face.

Given the breath of the problems that can be considered, there are many possible variations in the hardware components of the system in accordance with the present invention. First, the system needs a color image of surfaces that need to be examined. There are innumerable ways to generate a color image besides the color line scan camera chosen for this invention. Color array cameras could be used to image the surfaces. Three black and white line scan cameras could also be employed to image each surface. In the embodiment in which three black and white line scan cameras are used, one camera would have a red color filter, one camera would have a green color filter, and one camera would have a blue color filter. Three black and white array cameras could be used in a similar manner to image each part face. Indeed, any light sensing device that is sensitive in the 400 to 700 nanometer range and that allows filters to be used can be used as an imaging, device for this invention. Each filter would effectively determine the color that any one sensing, element can sense. At least three filters would have to be used and the colors they represent would have to be able to span color space. That is, suppose n color are used and let $F_1, \ldots, F_n$ represent the colors of these filters. Then any color C must be expressible as $$C=a_1F_1+a_2F_2+\ldots+a_nF_n$$

where $a_1, a_2, \ldots, a_n$ are non-negative real numbers. If an n filter imaging system is used, then the histograms used to do the color sorting will have to be n-dimensional. In this case, the analysis would proceed in a straightforward manner similar to that described above, as will be understood by those of skill in the art. Also, as described above, the Heckbert algorithm could be applied to this n-dimensional problem to reduce the dimensionality of the resulting analysis problem.

Solid state color cameras have filters over each sensing element. Three adjacent sensing elements having the combination of red, green, and blue filters over them, make up one color pixel. Hence, a color camera represents three filter images, $F_1$, $F_2$, and $F_3$, where $F_1$=R, $F_2$=G, and $F_3$=B. This filter combination satisfies the above stated requirement.

It is believed that the best color imaging device to use will be application dependent.

As to the number of imaging systems that should be employed, there need be enough to image all the surfaces that need be examined. Two imaging systems are used on the color and grain matching system for edge-glued panel parts, because one camera can image a complete part face, and only two part faces need to be examined. If large hides are being sorted, more cameras may be needed in order to image the complete hide surface. However, in analyzing hides only one surface need be considered.

As to the imaging geometry, the imaging device need not have its optical axis perpendicular to the surface of the item to be analyzed. Also, the optical axis of the imaging device need not be positioned as described above for the color and grain sorting system for wooden parts. The imaging geometry is very much application dependent. The geometry described above is used with respect to the color and grain sorting system for wooden parts because it minimizes the analysis that has to be performed on each surface. Regardless of the orientation of the imaging devices optical axis, the white target used for shading correction must be positioned in the plane defined by the surface that is to be analyzed.

As to the white target used in the shading correction, its reflectance characteristics are application-dependent. It should have a lighter intensity than any surface and/or part of a surface that is to be analyzed. Further it need not be inserted in the manner described above. The method for inserting the white target is problem-dependent. The easiest, most economical method of inserting this target preferably should be used. In some cases, an employee may insert the target manually. This is also true for the lens cap. Indeed, a lens cap might not be used. Any device that blocks light from entering the imaging device can be used.

With regard to the lighting, any lighting technology that provides adequate illumination for a part face to be imaged can be employed. For example, ordinary incadescent technology can be used. Drifts in the amount of light produced over the lifetime of the bulb can be adjusted by an illumination control system similar to the one described above with respect to the color and grain sorting system for wooden parts. High pressure gas discharge bulbs can also be used. These are becoming popular with the automotive industry and hence, the cost of these devices should fall.

Theoretically, such devices are even better than the tungsten halogen bulbs described above. However, they are currently much more expensive. Low pressure gas discharge bulbs, arc laps, and even fluorescent bulbs could be used.

Finally, lasers also could be used. Three different lasers would be needed, all different in color, or a mixed gas laser such as that described in U.S. Pat. No. 3,945,729 could be used. Suppose n filters of colors $F_1, \ldots, F_n$ are being used by an imaging device. Then the only requirement a light source or sources must satisfy is that it or they illuminate the part face in such a way that enough light passes through each filter for the each associated sensing element to register a reading. It is believed that the best illumination source to use will be application-dependent and will also depend on the type of imaging technology being used. For example, if an array camera is being used, a strobe light source might be appropriate so as to allow the item being examined to move continuously through the field of view without having to be stopped to be imaged.

As to the number of illuminators required, enough should be used to provide adequate surface illumination. The number to be used will be dependent on flow rate, the dimensions of the surfaces to be imaged, the distance the illuminators are from the surface they are illuminating, the candle power of each illuminator, and finally the distance each imaging device is from the surface it is imaging.

As to the lighting geometry, any geometry that allows the sources to provide adequate illumination can be used. However, for most applications one other factor, surface speculars, must be considered. Typically, the lighting should be arranged so that the imaging device will not image a surface specular. However, on some applications of this technology it may be desirable for the imaging devices to image speculars. The imaging geometry is application-dependent.

While maintaining a stability in lighting arguably improves color matching performance, bulbs can be powered by alternating current power sources. Similarly, light drift control is optional, although poorer color sorting results would be expected to occur without light drift control. In some problem areas where only rough color sorts are needed, maintaining constant illumination on an item's surface may not be required.

As to the number of power supplies used to power the illumination sources, a number of variations are possible. In the above-described color and grain sorting system for wooden parts, the choice was made to use one supply, as it is thought that this simplifies controlling light source drift. As will be appreciated by those of skill in the art, another possibility is to use one power supply for each surface to be imaged. For the color and grain sorting of wooden parts, two power supplies would be used, one for powering the light sources illuminating the top part face and one for illuminating the bottom part face. This configuration adds some complexity to automatic light drift control, but offers the advantage of being able to control the illumination of each part face independently.

A number of light source vendors sell light sources. Many vendors provide a direct current or a alternating current power supply in each source, where each source typically contains only one illuminator, e.g., a bulb. Hence, for practical engineering reasons, the number of power supplies used can range from one to the number of illuminators used on a system. Note that the lighting control algorithm increases in complexity as the number of light sources goes up.

With regard to automatic light drift control, the present invention uses a color line scan camera, the same camera that is used to image a part face, to sense light source drift. There are a number of other ways that drift can be corrected. All that is required is a light sensor and a control circuit. A possible sensor is a photo diode. The control circuit can be a specially-designed analog circuit, a special purpose digital circuit, or a digital circuit employing a microprocessor/microcontroller. The photo diode can be located above a target close to the field of view of a color imaging device, or be located adjacent an illuminator again looking a light reflecting target. It is known that at least one light source vendor is planning to develop a light source that has a photo diode and control circuitry contained in the source to reduce light drift.

Finally, with regard to the materials-handling system, the nature of the materials-handling system changes as a function of the item being analyzed. In particular, item size, item weight, item shape, and item throughput play important roles in designing an appropriate materials-handling system. Design requirements for the materials-handling system also depend on the imaging systems being used. If line scan technology is being employed, the materials-handling system is usually designed to maintain a constant velocity of throughput. If array imaging technology is being used, then the materials-handling system may have to stop the item while it is in the field of view of the camera so that the item can be imaged.

The need to air condition the electronic components of the system is also application-dependent. It depends on the environment where the application system will be located. In situations where the equipment is located in dusty, potential hot areas, using dust-free enclosures and air conditioning makes good sense. In more protected conditions, such enclosures would not be needed.

In view of the above-described modifications and variations, as well as others which are possible, it is therefore to be understood that, within the scope of the appended claims and their equivalents, the invention may be practiced otherwise than as specifically described.

What is claimed is:

1. Apparatus for the automatic color sorting of a part having top and bottom faces to be color and grain sorted, comprising:

a materials conveyor for moving the part;

top and bottom color cameras positioned to view the top and bottom faces, respectively, of the part, said top and bottom cameras defining fields of view through which the top and bottom faces pass and outputting color image data representing the colors of the top and bottom faces;

top and bottom light sources positioned to illuminate the top and bottom faces, respectively, of the part;

a power supply providing power to said top and bottom light sources; and computer means for analyzing the data from said top and bottom camera, said computer means including color sorting means for performing color sorting in real time with parts moving on said conveyor past said top and bottom cameras, said color sorting means including means for computing a black/white histogram of a part face based on the data analysis, and means for applying a character mark algorithm to the black/white histogram to find a threshold value for eliminating the effects of character marks from a part face for use in the color sorting of the part faces.

2. The apparatus of claim 1, further comprising first and second cooling enclosures enclosing said top and bottom cameras, respectively.

3. The apparatus of claim 1, further comprising:

a single input line electrically connecting said switching power supply to said computer means, said input line controlling the amount of power supplied to each of said top and bottom light sources; and voltage control means for permitting said computer means to control the voltage of said input line.

4. The apparatus of claim 3, wherein said voltage control means comprises a digital to analog converter.

5. The apparatus of claim 1, further comprising an air-conditioned dust free enclosure enclosing said computer means and power supply.

6. The apparatus of claim 1, further comprising top and bottom fiber optic light lines, light emitted by said top and bottom light sources being sent through said top and bottom fiber optic light lines, respectively, to illuminate the top and bottom faces.

7. The apparatus of claim 1, wherein each of said top and bottom light sources comprises at least two quartz tungsten halogen lamps.

8. The apparatus of claim 7, further comprising a plurality of fiber optic light lines optically connected to respective ones of said lamps, light emitted by said lamps being sent through said respective fiber optic light lines to illuminate the top and bottom faces, respectively.

9. The apparatus of claim 1, said apparatus further comprising first and second camera controllers interposed between said top and bottom cameras, respectively, and said computer means, said first and second camera controllers accepting analog data from said top and bottom cameras, respectively, and digitizing it for analysis by said computer means.

10. The apparatus of claim 9, wherein each of said first and second camera controllers each includes a single analog to digital converter, said apparatus further comprising a blue filter used on each of said top and bottom cameras.

11. The apparatus of claim 9, wherein each of said first and second camera controllers includes three separate analog to digital converters, each of said analog to digital converters having its own offset and gain.

12. The apparatus of claim 9, further comprising first and second targets selectively insertable into the fields of view of said top and bottom cameras, respectively, through which the part passes, said first and second targets being substantially identical to each other and having a reflectivity chosen based upon the reflectivity of the part; and wherein said first and second camera controllers include means for performing a rough analog shading correction prior to analog to digital conversion of the data, based on data collected from said top and bottom cameras while viewing said first and second targets, and for performing a fine analog shading correction following analog to digital conversion of the collected data.

13. The apparatus of claim 1, further comprising direct memory access computer interface means for directly transferring the data from said top and bottom cameras to said computer means.

14. The apparatus of claim 13, further comprising a first sensor for determining when a part is about to enter the field of view of said top and bottom cameras; and a second sensor for determining the number of pixels on each of said top and bottom cameras which must be read.

15. The apparatus of claim 14, wherein said first sensor is an optical sensor and said second sensor is an ultrasonic sensor.

16. The apparatus of claim 1, further comprising high speed processing board means for processing the data from said top and bottom cameras and direct memory access computer interface means for transferring the processed data from said interface means to said computer means.

17. The apparatus of claim 1, further comprising first and second targets insertable into said fields of view of said top and bottom cameras, respectively, outside which the part passes.

18. The apparatus of claim 1, wherein said top and bottom light sources each have a smooth spectral energy distribution from about 400 to about 700 nm and a substantially stable spectral energy distribution function across its lifetime, and are of a type that does not have spectral lines of the type present in the light output by most fluorescent bulbs.

19. The apparatus of claim 1, wherein said apparatus is also for the grain sorting of a part, and wherein said computer means further includes training means for teaching said computer means to identify color classes to be used during sorting, training means for teaching said computer means to identify grain classes to be used during sorting, and grain sorting means for performing sorting means for performing color and grain sorting in real time with parts moving on said conveyor past said top and bottom cameras, grain sorting in real time with parts moving on said conveyor past said top and bottom cameras, and utility means for allowing an operator to display images and perform system tests.

20. The apparatus of claim 19, wherein said color cameras have red, green, and blue channels; and wherein said color class identification training means includes:

means for applying a shading compensation algorithm to a color image of a training sample collected by one of said cameras to produce a shading compensated color image;

means for using the shading compensated color image to average the red, green, and blue channel values to form a black and white image;

means for applying a preselected threshold to the black and white image to find and remove background pixels in the black and white image from further consideration;

means for using the shading compensated color image to compute a three-dimensional color histogram for the training sample, ignoring any background pixels;

means for using the black and white image to compute the black/white histogram for the training sample, again ignoring any background pixels;

means for applying a character mark detection algorithm to the black/white histogram to find a threshold value for eliminating the effect of character marks;

means for removing character mark pixels from the three-dimensional color histogram using the threshold value for eliminating the effects of character marks from a training sample;

means for normalizing the three-dimensional color histogram to convert it to an estimated probability function of the training sample;

means for adding the estimated probability function of the training sample to a running sum of three-dimensional estimated probability functions for the color class;

means for also adding the estimated probability function of the training sample to a running sum for all color classes;

means for applying a color mapping algorithm to the running sum for all color classes to produce a color lookup table;

means for using the color lookup table to map the estimated probability function for each training sample into a first reduced measurement vector;

means for using the color lookup table to map each running sum of three-dimensional estimated probability functions for a color class into a second reduced measurement vector;

means for determining a single prototype for each color class based on the second reduced measurement vector; and means for estimating a threshold for each color class by examining the first reduced measurement vector for all the color classes and selecting the threshold that gives the minimum probability of error.

21. The apparatus of claim 19, wherein said color cameras have red, green, and blue channels; and wherein said color class identification training means includes:

means for applying a shading compensation algorithm to a color image of a training sample collected by one of said cameras to produce a shading compensated color image;

means for using the shading compensated color image to average the red, green, and blue channel values to form a black and white image;

means for applying a preselected threshold to the black and white image to find and removing background pixels in the black and white image from further consideration;

means for using the shading compensated color image to compute a three-dimensional color histogram for the training sample, ignoring any background pixels;

means for using the black and white image to compute a black/white histogram for the training sample, again ignoring any background pixels;

means for applying a character mark detection algorithm to the black/white histogram to find a threshold value for eliminating the effect of character marks from a training sample;

means for removing character mark pixels from the three-dimensional color histogram using the threshold value for eliminating the effects of character marks from a training sample;

means for normalizing the three-dimensional color histogram to convert it to an estimated probability function of the training sample;

means for adding the estimated probability function of the training sample to a running sum of three-dimensional estimated probability functions for the color class;

means for also adding the estimated probability function of the training sample to a running sum for all color classes;

means for applying a color mapping algorithm to the running sum for all color classes to produce a color lookup table;

means for using the color lookup table to map the estimated probability function for each training sample into a reduced measurement vector;

means for using the color lookup table to map each estimated probability function into a reduced measurement vector; and means for estimating the threshold for each color class by examining all of the training samples for all the color classes and selecting the threshold that gives the best results.

22. The apparatus of claim 19, wherein said color class identification training means further includes color mapping means for reducing the size of a measurement vector needed to represent one of the faces of one of the parts and for removing colors that might be character marks from the training samples.

23. The apparatus of claim 19, wherein said color class identification training means includes means for producing a color lookup table and means for determining a prototype for each color class using the lookup table; and wherein said color sorting means further includes:

means for shade compensating a color image of a training sample collected by one of said cameras to remove non-uniformities in light and in sensing element sensitivities across the filed of view;

means for averaging the red, green, and blue components of each color pixel in the shade compensated color image to create a black and white image;

means for applying a threshold to the black and white image to remove background pixels in the black and white image from consideration;

means for computing a reduced measurement vector of the part face using the color lookup table produced by said color class identification training means;

means for removing character mark pixels from the reduced measurement vector using the threshold value for eliminating the effects of character marks from a part face;

means for normalizing the reduced measurement vector to form a normalized reduced measurement vector of the part face;

means for removing character mark colors from each of the prototypes;

means for forming a new set of modified prototypes with the effects of character marks removed from consideration;

means for computing the distance of the normalized reduced measurement vector of the part face from each of the prototypes; and means for assigning a color class to the part face based on said distance.

24. The apparatus of claim 19, wherein said color class identification training means includes means for producing a color lookup table and means for determining a prototype for each color class using the lookup table; and wherein said color sorting means further includes:

means for shade compensating a color image of a part face collected by one of said cameras to remove non-uniformities in light and in sensing element sensitivities across the filed of view;

means for averaging the red, green, and blue components of each color pixel in the shade compensated color image to create a black and white image;

means for applying a threshold to the black and white image to remove background pixels in the black and white image from consideration;

means for computing a reduced measurement vector of the part face using the color lookup table produced by said color class identification training means;

means for removing character mark pixels from the reduced measurement vector using the threshold value for eliminating the effects of character marks from a part face;

means for normalizing the reduced measurement vector to form a normalized reduced measurement vector of the part face;

means for removing character mark colors from each training sample to create a modified measurement vector for each training sample;

means for normalizing the modified measurement vector for each training sample;

means for computing the distance value of the normalized reduced measurement vector of the part face from the normalized reduced measurement vector for each training sample;

means for finding the k smallest of the distance values;

means for finding the color class label that occurs the most often in the training vectors with the k smallest distances; and means for assigning the part face to a color class based on the smallest distance.

25. The apparatus of claim 19, wherein said color sorting means further includes color mapping means for reducing the size of a measurement vector needed to represent one of the faces of one of the parts and wherein said means for applying a character mark algorithm also functions to remove colors that might be character marks from the two reduced measurement vectors used to represent the color of each part face.

26. The apparatus of claim 19, wherein said color cameras have red, green, and blue channels; and wherein said grain class identification training means includes:

means for applying a shading compensation algorithm to a color image of a training sample collected by one of said cameras to remove non-uniformities in lighting and in camera sensing element sensitivities across the field of view to produce a shading compensated color image;

means for using the shading compensated color image to average the red, green, and blue channel values to form a black and white image;

means for applying a preselected threshold to the black and white image to find and remove background pixels in the black and white image from further consideration;

means for using the black and white image to compute a black/white histogram for the part face, ignoring any background pixels;

means for applying a character mark algorithm to the black/white histogram to find a threshold value for eliminating the effects of character marks from a training sample;

means for removing character mark pixels from the black/white histogram using the threshold value for eliminating the effects of character marks from a training sample;

means for removing character mark areas from further consideration by labeling them as background pixels in the black and white image;

means for computing a normalizing factor;

means for applying an equal probability quantizing algorithm to the black and white image of the part, the black/white histogram, the normalizing factor, and the number of gray levels that are to appear in a requantized version of the black and white image to obtain the requantized version of the black and white image;

means for applying edge detectors respectively most sensitive to the vertical, horizontal, right diagonal, and left diagonal edges to the requantized version of the black and white image to obtain gradient images which record the absolute values of, respectively, the vertical, horizontal, right diagonal, and left diagonal edges;

means for averaging the left and right diagonal gradient images to find a single gradient image that indicates the number of diagonal edges present in either the right or left diagonal dimensions;

means for creating an edge histogram and normalizing it;

means for finding a class prototype for each color class; and means for estimating a threshold for each color class by examining the normalized edge histogram for all the training samples for all the color classes and selecting the threshold that gives the minimum probability of error.

27. The apparatus of claim 19, wherein said color cameras have red, green, and blue channels; and wherein said grain class identification training means includes:

means for applying a shading compensation algorithm to a color image of a training sample collected by one of said cameras to remove non-uniformities in lighting and in camera sensing element sensitivities across the field of view to produce a shading compensated color image;

means for using the shading compensated color image to average the red, green, and blue channel values to form a black and white image;

means for applying a preselected threshold to the black and white image to find and remove background pixels in the black and white image from further consideration;

means for using the black and white image to compute a black/white histogram for the part face, ignoring any background pixels;

means for applying a character mark algorithm to the black/white histogram to find a threshold value for eliminating the effects of character marks from a training sample;

means for removing character mark pixels from the black/white histogram using the threshold value for eliminating the effects of character marks from a training sample;

means for removing character mark areas from further consideration by labeling them as background pixels in the black and white image;

means for computing a normalizing factor;

means for applying an equal probability quantizing algorithm to the black and white image of the part, the black/white histogram, the normalizing factor, and the number of gray levels that are to appear in a requantized version of the black and white image to obtain the requantized version of the black and white image;

means for applying edge detectors respectively most sensitive to the vertical, horizontal, right diagonal, and left diagonal edges to the requantized version of the black and white image to obtain gradient images which record the absolute values of, respectively, the vertical, horizontal, right diagonal, and left diagonal edges;

means for averaging the left and right diagonal gradient images to find a single gradient image that indicates the number of diagonal edges present in either the right or left diagonal dimensions;

means for creating an edge histogram and normalizing it; and means for estimating a threshold for each grain class by examining the normalized edge histogram for all the training samples for all the grain classes and selecting the threshold that gives the best results.

28. The apparatus of claim 19, wherein said grain class training identification means includes means for determining a prototype for each grain class; and wherein said grain sorting means includes:

means for removing character mark pixels from the black/white histogram of the best part face;

means for removing character mark areas from further consideration by labeling them as background pixels in the black and white image of the best part face;

means for computing a normalizing factor;

means for applying an equal probability quantizing algorithm to the black and white image of the best part face, the black/white histogram of the black and white image of the best part face, the normalizing factor, and the number of gray levels that are to appear in a requantized version of the black and white image to obtain the requantized version of the black and white image;

means for applying edge detectors respectively most sensitive to the vertical, horizontal, right diagonal, and left diagonal edges to the requantized version of the black and white image to obtain gradient images which record the absolute values of, respectively, the vertical, horizontal, right diagonal, and left diagonal edges;

means for averaging the left and right diagonal gradient images to find a single gradient image that indicates the number of diagonal edges present in either the right or left diagonal dimensions;

means for creating an edge histogram and normalizing it;

means for computing the distance of the normalized edge histogram from each of the prototypes; and means for assigning a grain pattern class to the part face based on the distance.

29. The apparatus of claim 19, wherein said grain class training identification means includes means for determining a prototype for each grain class; and wherein said grain sorting means includes:

means for removing character mark pixels from the black/white histogram of the best part face;

means for removing character mark areas from further consideration by labeling them as background pixels in the black and white image of the best part face;

means for computing a normalizing factor;

means for applying an equal probability quantizing algorithm to the black and white image of the best part face, the black/white histogram of the black and white image of the best part face, the normalizing factor, and the number of gray levels that are to appear in a requantized version of the black and white image to obtain the requantized version of the black and white image;

means for applying edge detectors respectively most sensitive to the vertical, horizontal, right diagonal, and left diagonal edges to the requantized version of the black and white image to obtain gradient images which record the absolute values of, respectively, the vertical, horizontal, right diagonal, and left diagonal edges;

means for averaging the left and right diagonal gradient images to find a single gradient image that indicates the number of diagonal edges present in either the right or left diagonal dimensions; creating an edge histogram and normalizing it;

means for computing the distance of the normalized edge histogram from each of the training samples;

means for finding the grain class label that occurs the most often in the training vectors with the k smallest distances; and means for assigning the part face to a grain class based on the smallest distance.

30. The apparatus of claim 1, wherein said color cameras have red, green, and blue channels; and wherein said computer means includes normalizing means for executing a normalizing algorithm to normalize variations in sensitivity between said top and bottom cameras, said normalizing means including:

means for applying a shading correction algorithm to color images of color samples collected from said top and bottom cameras;

means for computing the values of matrices representing the relative red, green and blue responses of said top and bottom cameras based on the shading corrected color component images collected from said top and bottom cameras;

means for creating two-dimensional plots of the relative red, green, and blue responses of said top and bottom cameras to all of the color targets, with the horizontal axes of the plots representing the output gray level value for the red, green, and blue channels of one of said top and bottom cameras and the vertical axes of the plots representing the output gray level value for the red, green, and blue channels of the other of said top and bottom cameras;

means for terminating execution of the normalizing algorithm, if the function y=x is the function that best fits the points on all three of the red, green, and blue plots;

means for estimating the degree of polynomial function that appears to best fit the relative response data;

means for terminating execution of the normalizing algorithm, if the function y=x is not the function that best fits the points on all three of the red, green, and blue plots;

means for defining a function for each graph that fits the data, using a least squares fitting program; and means for creating three lookup tables that map the output of one of said top and bottom cameras into the output of the other of said top and bottom cameras.

31. A method of automatically color sorting a part having opposite top and bottom faces to be color sorted, comprising the steps of:

providing top and bottom color cameras positioned to view the top and bottom faces, respectively, of a part, the top and bottom cameras defining fields of view through which the top and bottom faces pass;

illuminating the fields of view;

moving the part past the top and bottom cameras so that the top and bottom faces pass through the fields of view of the top and bottom cameras;

using the top and bottom cameras to output color image data representing the colors of the top and bottom faces;

computing black/white histograms of each of the top and bottom faces based on the color image data output by the cameras;

applying a character mark algorithm to the black/white histograms of each of the top and bottom faces to produce a threshold value for eliminating the effects of character marks from a part face for use in the color sorting of each of the top and bottom faces;

eliminating the effects of character mark from the data from the top and bottom cameras using the threshold value produced by the character mark algorithm for eliminating the effects of character marks from a part face;

determining the color class of the top and bottom faces based on the data from the top and bottom cameras; and determining which of the top and bottom faces is the better looking based on the determination of the color class of the top and bottom faces.

32. The method of claim 31, further comprising cooling the top and bottom cameras to maintain them at a substantially constant temperature.

33. The method of claim 31, further comprising controlling the amount of power supplied to each of the light sources by controlling the amount of voltage on the input line from the power supply to the light sources.

34. The method of claim 33, wherein said step of controlling the amount of power comprises placing a target in the field of view of one of the top and bottom cameras, averaging the picture elements of the camera that cover an area of the target, comparing the average to a standard, and if necessary adjusting the voltage applied to the input line based on the comparison.

35. The method of claim 31, wherein said illuminating step comprises sending light emitted by top and bottom light sources through fiber optic light lines to illuminate the top and bottom faces.

36. The method of claim 31 wherein said illuminating step comprises using light sources having a smooth spectral energy distribution from about 400 to about 700 nm and a substantially stable spectral energy distribution function across its lifetime, and being of a type that do not have spectral lines of the type present in the light output by fluorescent bulbs.

37. The method of claim 31, further comprising the step of digitizing the data from the top and bottom cameras prior to said step of determining the color class of the top and bottom faces.

38. The method of claim 37, further comprising filtering light entering the top and bottom cameras using blue filters.

39. The method of claim 37, further comprising the steps of performing a rough analog shading correction prior to said digitizing step and performing a fine analog shading correction following said digitizing step.

40. The method of claim 31, further comprising the steps of determining when a part is about to enter the field of view of said top and bottom cameras; and determining the number of pixels on each of said top and bottom cameras which must be read.

41. A method of automatically color sorting a part having opposite top and bottom faces to be color sorted, comprising the steps of:

providing a color sorting system including:

top and bottom color cameras positioned to view the top and bottom faces, respectively, of a part and for outputting color image data representing the colors of the top and bottom faces; and processing means for processing the data from the top and bottom cameras;

training the system to identify a plurality of color classes that are to be used during color sorting;

collecting a color image of the part face using the cameras;

computing black/white histograms of each of the top and bottom faces based on the color image data output by the cameras;

applying a character mark algorithm to the black/white histograms of each of the top and bottom faces to produce a threshold value for eliminating the effects of character marks from a part face for use in the color sorting of each of the top and bottom faces;

eliminating the effects of character marks from the data from the top and bottom cameras using the threshold value for eliminating the effects of character marks from a part face; and performing color sorting with parts moving through the system using the data from the top and bottom cameras, based on the color classes identified during said training step.

42. The method of claim 41, wherein said step of teaching the system to identify the color classes includes removing the effects of varying intensities among the color classes from the output of edge detectors, using an equal probability quantizing algorithm.

43. The method of claim 41, wherein the color cameras have red, green, and blue channels and wherein said color class training step includes:

collecting a color image of a training sample using the cameras;

applying a shading compensation algorithm to the color image of the training sample to produce a shading compensated color image of the training sample;

using the shading compensated color image to average the red, green, and blue channel values to form a black and white image;

applying a preselected threshold to the black and white image to find and remove background pixels in the black and white image from further consideration;

using the shading compensated color image to compute a three-dimensional color histogram for the training sample, ignoring any background pixels found in said step of applying a preselected threshold;

using the black and white image to compute a black/white histogram for the training sample, again ignoring any background pixels found in said step of applying a preselected threshold;

applying a character mark detection algorithm to the black/white histogram to find a threshold value for eliminating the effects of character marks from a training sample;

removing character mark pixels from the three-dimensional color histogram using the threshold value for eliminating the effects of character marks from a training sample;

normalizing the three-dimensional color histogram to convert it to an estimated probability function of the training sample;

adding the estimated probability function of the training sample to a running sum of three-dimensional estimated probability functions for the color class;

also adding the estimated probability function of the training sample to a running sum for all color classes;

repeating the above steps for additional training samples;

applying a color mapping algorithm to the running sum for all color classes to produce a color lookup table;

using the color lookup table to map the estimated probability function for each training sample into a first reduced measurement vector;

using the color lookup table to map each running sum of three-dimensional estimated probability functions for a color class into a second reduced measurement vector;

determining a single prototype for each color class based on the second reduced measurement vector; and for each color class estimating a threshold by examining the first reduced measurement vector for all the color classes and selecting the threshold that gives the minimum probability of error.

44. The method of claim 43, wherein said step of applying a shading correction algorithm includes collecting a selected number of lines of color image data from one of the cameras while a lens cap is on the cameras, computing the average response for each pixel in each channel of data, removing the lens cap and scanning the selected number of lines of color image data off the white target, computing the average response for each pixel in each channel of data, and applying the steps of a standard shading correction algorithm to the color imagery as it is being collected.

45. The method of claim 41, wherein the color cameras have red, green, and blue channels and wherein said color class training step includes:

collecting a color image of a training sample using the cameras;

applying a shading compensation algorithm to the color image of the training sample to produce a shading compensated color image of the training sample;

using the shading compensated color image to average the red, green, and blue channel values to form a black and white image;

applying a preselected threshold to the black and white image to find and remove background pixels in the black and white image from further consideration;

using the shading compensated color image to compute a three-dimensional color histogram for the training sample, ignoring any background pixels found in said step of applying a preselected threshold;

using the black and white image to compute a black/white histogram for the training sample, again ignoring any background pixels found in said step of applying a preselected threshold;

applying a character mark detection algorithm to the black/white histogram to find a threshold value for eliminating the effects of character marks from a training sample;

removing character mark pixels from the three-dimensional color histogram using the threshold value for eliminating the effects of character marks from a training sample;

normalizing the three-dimensional color histogram to convert it to an estimated probability function of the training sample;

adding the estimated probability function of the training sample to a running sum of three-dimensional estimated probability functions for the color class;

also adding the estimated probability function of the training sample to a running sum for all color classes;

repeating the above steps for additional training samples;

applying a color mapping algorithm to the running sum for all color classes to produce a color lookup table;

using the color lookup table to map the estimated probability function for each training sample into a reduced measurement vector;

using the color lookup table to map each estimated probability function into a reduced measurement vector; and for each color class, estimating the threshold by examining all of the training samples for all the color classes and selecting the threshold that gives the best results.

46. The method of claim 45, wherein said step of applying a shading correction algorithm includes collecting a selected number of lines of color image data from one of the cameras while a lens cap is on the cameras, computing the average response for each pixel in each channel of data, removing the lens cap and scanning the selected number of lines of color image data off the white target, computing the average response for each pixel in each channel of data, and applying the steps of a standard shading correction algorithm to the color imagery as it is being collected.

47. The method of claim 41, wherein said color class training identification step includes producing a color lookup table and determining a prototype for each color class; and wherein said color sorting step further includes:

after said step of collecting a color image of the part face using the cameras, shade compensating the color image of the part face to remove non-uniformities in light and in sensing element sensitivities across the field of view;

averaging the red, green, and blue components of each color pixel in the shade compensated color image to create a black and white image;

applying a threshold to the black and white image to remove background pixels in the black and white image from consideration;

computing a reduced measurement vector of the part face using the color lookup table computed in said color class identification training step;

performing said step of eliminating the effects of character marks from the data from the top and bottom cameras by removing character mark pixels from the reduced measurement vector of the part face using the threshold value for eliminating the effects of character marks from a part face;

normalized the reduced measurement vector to form the normalized reduced measurement vector of the part face;

removing character mark colors from each of the prototypes;

forming a new set of modified prototypes with the effects of character marks removed from consideration;

computing the distance of the normalized reduced measurement vector of the part face from each of the prototypes; and assigning a color class to the part face based on the distance.

48. The method of claim 47, further comprising the steps of using information about the class label of the color class to which the face has been assigned, a distance measure, and the clear area of the part face to determine which of the two faces of a part is the best face.

49. The method of claim 41, wherein said color class training identification step includes producing a color lookup table; and wherein said color sorting step further includes:

shade compensating the color image of the part face to remove non-uniformities in light and in sensing element sensitivities across the filed of view;

averaging the red, green, and blue components of each color pixel in the shade compensated color image to create a black and white image;

applying a threshold to the black and white image to remove background pixels in the black and white image from consideration;

computing a reduced measurement vector of the part face using the color lookup table computed in said color class identification training step;

performing said step of eliminating the effects of character marks from the data from the top and bottom cameras by removing character mark pixels from the reduced measurement vector of the part face using the threshold value for eliminating the effects of character marks from a part face;

normalizing the reduced measurement vector of the part face to create a normalized reduced measurement vector of the part face;

removing character mark colors from each training sample to create a modified measurement vector for each training sample;

normalizing the modified measurement vector for each training sample to create a normalized measurement vector for each training sample;

computing the distance value of the normalized reduced measurement vector of the part face from the normalized reduced measurement vector for each training sample;

finding the k smallest of the distance values;

finding the color class label that occurs the most often in the training vectors with the k smallest distances; and assigning the part face to a color class based on the smallest distance.

50. The method of claim 49, further comprising the steps of using information about the class label of the color class to which the face has been assigned, a distance measure, and the clear area of the part face to determine which of the two faces of a part is the best face.

51. The method of claim 41, wherein said method also includes grain sorting of the part and said method further includes:

training the system to identify the grain classes that are to be used during grain sorting; and performing grain sorting on the parts which have been color sorted; and wherein the color cameras have red, green, and blue channels and wherein said grain class training step includes:

collecting a color image of a training sample using the cameras;

applying a shading compensation algorithm to the color image of the training sample to remove non-uniformities in lighting and in camera sensing element sensitivities across the field of view to produce a shading compensated color image of the training sample;

using the shading compensated color image to average the red, green, and blue channel values to form a black and white image;

applying a preselected threshold to the black and white image, removing background pixels in the black and white image from further consideration;

using the black and white image to compute a black/white histogram for the part face, ignoring any background pixels;

applying a character mark algorithm to the black/white histogram to find a threshold value for eliminating the effects of character marks from a training sample;

removing character mark pixels from the black/white histogram using the threshold value for eliminating the effects of character marks from a training sample;

removing character mark areas from further consideration by labeling them as background pixels in the black and white image;

computing a normalizing factor;

applying an equal probability quantizing algorithm to the black and white image of the part, the black/white histogram, the normalizing factor, and the number of gray levels that are to appear in a requantized version of the black and white image to obtain the requantized version of the black and white image;

applying edge detectors respectively most sensitive to the vertical, horizontal, right diagonal, and left diagonal edges to the requantized version of the black and white image to obtain gradient images which record the absolute values of, respectively, the vertical, horizontal, right diagonal, and left diagonal edges;

averaging the left and right diagonal gradient images to find a single gradient image that indicates the number of diagonal edges present in either the right or left diagonal dimensions;

creating an edge histogram and normalizing it;

finding a class prototype for each color class; and for each color class estimating a threshold by examining the normalized edge histogram for all the training samples for all the color classes and selecting the threshold that gives the minimum probability of error.

52. The method of claim 41, wherein said method also includes grain sorting of the part and said method further includes:

training the system to identify the grain classes that are to be used during grain sorting; and performing grain sorting on the parts which have been color sorted; and wherein the color cameras have red, green, and blue channels and wherein said grain class training step includes:

collecting a color image of a training sample using the cameras;

applying the shading compensation algorithm to the color image of the training sample to remove non-uniformities in lighting and in camera sensing element sensitivities across the field of view to produce a shading compensated color image of the training sample;

using the shading compensated color image to average the red, green, and blue channel values to form a black and white image;

applying a preselected threshold to the black and white image, to find and remove background pixels in the black and white image from further consideration;

using the black and white image to compute a black/white histogram for the part face, ignoring any background pixels;

applying a character mark algorithm to the black/white histogram to find a threshold value for eliminating the effects of character marks;

removing character mark pixels from the black/white histogram using the threshold value for eliminating the effects of character marks;

removing character mark areas from further consideration by labeling them as background pixels in the black and white image;

computing a normalizing factor;

applying an equal probability quantizing algorithm to the black and white image of the part, the black/white histogram, the normalizing factor, and the number of gray levels that are to appear in a requantized black and white image to obtain the requantized version of the black and white image;

applying edge detectors respectively most sensitive to the vertical, horizontal, right diagonal, and left diagonal edges to the requantized version of the black and white image to obtain gradient images which record the absolute values of, respectively, the vertical, horizontal, right diagonal, and left diagonal edges;

averaging the left and right diagonal gradient images to find a single gradient image that indicates the number of diagonal edges present in either the right or left diagonal dimensions; creating an edge histogram and normalizing it; and estimating a threshold for each grain class by examining the normalized edge histogram for all the training samples for all the grain classes and selecting the threshold that gives the best results.

53. The method of claim 41, wherein said method also includes grain sorting in said method further includes:

training the system to identify the grain classes that are to be used during grain sorting; and performing grain sorting on the parts which have been color sorted; and wherein said grain sorting step includes:

removing character mark pixels from the black/white histogram of the best part face;

removing character mark areas from further consideration by labeling them as background pixels in the black and white image of the best part face;

computing a normalizing factor;

applying an equal probability quantizing algorithm to the black and white image of the best part face, the black/white histogram of the black and white image of the best part face, the normalizing factor, and the number of gray levels that are to appear in a requantized black and white image to obtain the requantized version of the black and white image;

applying edge detectors respectively most sensitive to the vertical, horizontal, right diagonal, and left diagonal edges to the requantized version of the black and white image to obtain the gradient images which record the absolute values of, respectively, the vertical, horizontal, right diagonal, and left diagonal edges;

averaging the left and right diagonal gradient images to find a single gradient image that indicates the number of diagonal edges present in either the right or left diagonal dimensions;

creating an edge histogram and normalizing it;

computing the distance of the normalized edge histogram from each of the prototypes; and assigning a grain pattern class to the part face based on the distance.

54. The method of claim 41, wherein said method also includes grain sorting of the part and said method further includes:

training the system to identify the grain classes that are to be used during grain sorting; and performing grain sorting on the parts which have been color sorted; and wherein said grain sorting step includes:

removing character mark pixels from the black/white histogram of the best part face;

removing character mark areas from further consideration by labeling them as background pixels in the black and white image of the best part face;

computing a normalizing factor;

applying an equal probability quantizing algorithm to the black and white image of the best part face, the black/white histogram of the black and white image of the best part face, the normalizing factor, and the number of gray levels that are to appear in a requantized black and white image to obtain the requantized version of the black and white image;

applying edge detectors respectively most sensitive to the vertical, horizontal, right diagonal, and left diagonal edges to the requantized version of the black and white image to obtain gradient images which record the absolute values of, respectively, the vertical, horizontal, right diagonal, and left diagonal edges;

averaging the left and right diagonal gradient images to find a single gradient image that indicates the number of diagonal edges present in either the right or left diagonal dimensions;

creating an edge histogram and normalizing it;

computing the distance of the normalized edge histogram from the training sample;

finding the k smallest of the distance values;

finding the grain class label that occurs the most often in the training vectors with the k smallest distances; and assigning the part face to a grain class based on the smallest distance.

55. The method of claim 41, wherein said training step is carried out using a plurality of color samples, said method further including the step of normalizing variations in sensitivity between the top and bottom cameras, said normalizing step including:

for each color sample, scanning the color sample to collect a color image of the sample from both cameras;

applying a shading correction algorithm to the color images from both cameras to produce shading corrected color images, and computing the values of matrices representing the relative red, green and blue responses of the two cameras based on the shading corrected color images collected from both cameras;

creating a two-dimensional plot of the relative red responses of the two cameras to all of the color targets, with the horizontal axis of the two-dimensional plot representing the output gray level value for the red channel of the first camera and the vertical axis of the two-dimensional plot representing the output gray level value for the red channel of the second camera;

creating a two-dimensional plot of the relative green responses of the two cameras to all of the color targets, with the horizontal axis of the two-dimensional plot representing the output gray level value for the green channel of the first camera and the vertical axis of the two-dimensional plot representing the output gray level value for the green channel of the second camera;

creating a two-dimensional plot of the relative blue responses of the two cameras to all of the color targets, with the horizontal axis of the two-dimensional plot representing the output gray level value for the blue channel of the first camera and the vertical axis of the two-dimensional plot representing the output gray level value for the blue channel of the second camera;

determining if the function y=x is the function that best fits the points on all three of the red, green, and blue plots;

if y=x provides the best fit, terminating execution of the normalizing algorithm, as adjustment in either camera output is unneeded;

if y=x does not provide the best fit, estimating the degree of polynomial function that appears to best fit the relative response data;

defining a function for each graph that fits the data, using a least squares fitting program; and creating three lookup tables that map the output of the first camera into the output of the second camera.

* * * * *